US005685435A

United States Patent [19]

Picioccio et al.

[11] Patent Number: 5,685,435

[45] Date of Patent: Nov. 11, 1997

[54] METHOD AND APPARATUS FOR AUTOMATIC BULK VENDING

[75] Inventors: John J. Picioccio, Bloomingdale; Steven D. Kienitz, Sparta, both of N.J.; Warren R. Kitchen, E. Stroudsburg, Pa.; Joseph E. Rossi, Washington, N.J.; William C. Haase, Long Valley, N.J.; Allison T. Ono, Oxford, N.J.; Wayne R. Hinkle, Pen Argyl, Pa.

[73] Assignee: Mars Incorporated, McLean, Va.

[21] Appl. No.: 436,634

[22] Filed: May 8, 1995

[51] Int. Cl.[6] ..... B07B 13/05

[52] U.S. Cl. ..... 209/677; 222/2; 222/144.5; 222/189.02

[58] Field of Search ..... 222/144.5, 81, 222/2, 129, 145.1, 189.02; 221/96; 209/677, 675, 281; 141/9, 100, 104, 105, 174, 329

[56] References Cited

U.S. PATENT DOCUMENTS

| | | | |
|---|---|---|---|
| 1,016,424 | 2/1912 | Loveland | 209/281 |
| 2,319,725 | 5/1943 | Drinkwater | 222/189.02 X |
| 3,587,918 | 6/1971 | Cornelius | 221/96 |
| 4,276,750 | 7/1981 | Kawasumi | 221/96 X |
| 4,531,342 | 7/1985 | Wittenborg | 222/2 X |
| 4,576,313 | 3/1986 | Smith et al. | 222/81 |
| 4,815,633 | 3/1989 | Kondo et al. | 221/96 X |
| 5,344,046 | 9/1994 | Maldanis et al. | 222/2 |

*Primary Examiner*—David H. Bollinger
*Attorney, Agent, or Firm*—Fish & Richardson P.C.

[57] ABSTRACT

An automatic bulk vending machine is described including specific details as to various aspects of accurate volumetric dispensing, the separation of small broken pieces or fines from the dispensed product, and the easy and sanitary loading of such a machine. Further details as to how to provide a highly flexible selection process are provided. An automatic bulk vending machine according to the present invention may include a touch-screen for providing a visually entertaining and instructive display to guide a customer through the product selection process. Products to be selected may be stored in bins and volumetrically dispensed by a dispenser to a blending and holding pan. From this pan, they are then directed through a dispenser tube including a fines separator and collector to a dispensing cup. Bulk refill containers are also disclosed. Unlike an ordinary vending machine, the customer can choose the blend of product to be purchased. Unlike manual bulk vending, the automatic bulk vending machine is automatic and sanitary.

30 Claims, 27 Drawing Sheets

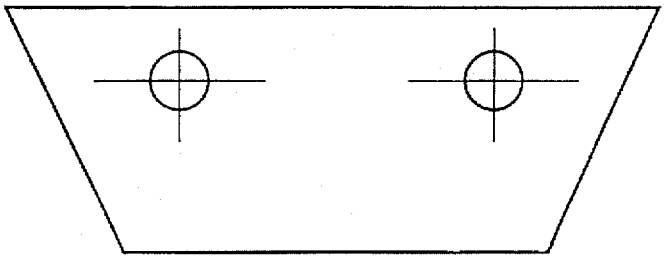
FIG. 8D
FIG. 8E
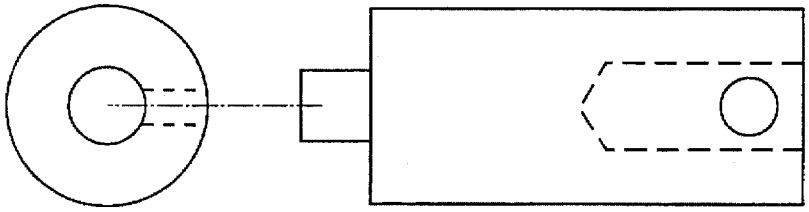
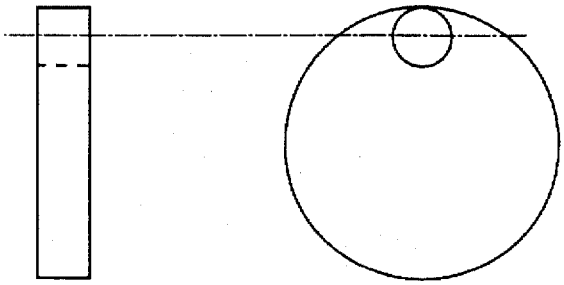
FIG. 8F

METHOD AND APPARATUS FOR AUTOMATIC BULK VENDING

FIELD OF THE INVENTION

The invention relates generally to improvements in methods and apparatus for automatic vending, and, more specifically, to improved vending machines and methods which permit automatic bulk vending with a high degree of flexibility as to pricing and selection with relatively easy loading and maintenance of sanitary conditions. Preferably, vending machines and methods according to the present invention also operate in a pleasing and customer engaging manner which tends to maximize sales and customer satisfaction.

BACKGROUND OF THE INVENTION

Automatic vending through the use of vending machines is well known. Such machines include candy and snack machines which dispense candy bars, bagged candies, chips and the like in packaged portions for a price determined by the operator of the vending machine. In actual operation, a customer might insert coins or currency equalling or exceeding the price of the desired item and then press a selection button or buttons to select the item. The vending machine dispenses the item and returns the customer's change, if any is owed.

Such machines are highly advantageous, but suffer from a number of drawbacks. For example, loading such machines can be tedious and time consuming as a full vending machine may store hundreds or even thousands of individual items. Further, the potential working volume of most typical vending machines is not very efficiently used as a substantial portion of that volume consists of unutilized air space.

Additionally, a customer of a typical vending machine is limited to selecting a portion or multiple portions defined by someone else. If a customer wants less or more of a product, or a different mix of product, he or she is presently limited to the predetermined portions in the predetermined mix stocked in the machine. Alternatively, if a customer has a given amount of money, unless that amount matches the price of the item, it is not presently an option to buy as much product as one has money. If the customer has less than the minimum item cost, no product can be purchased. In each of the above situations, customer satisfaction is not maximized. In several of the above cases, sales are not maximized. From the above, it can be seen that additional flexibility and selectivity can be highly desirable both to the operator and the customer.

One relatively new type of vending machine attempts to provide additional customer flexibility and selectivity in the context of vending greeting cards. One such machine is the Creata-Card computer kiosk built by American Greetings Industries, Inc. This kiosk allows a customer to choose graphics, write messages and print them on blank cards. Hallmark Cards Inc. apparently has a similar product called Touch-Screen Greetings. Although such machines employ touch screens with animated displays, they do not appear to shed much light on the automatic bulk vending of consumable items such as candy and other snacks suited to bulk vending.

Manual bulk vending is also well known. By way of example, candy stores, grocery stores and movie theaters often have bulk containers of candy and other items that can be selected and bagged, or otherwise put in containers, by customers. The manually selected items are then priced and sold based upon the weight of the item taken. Such systems are not automatic and are susceptible to concerns with respect to maintaining proper sanitary control of the items sold, as the maintenance of sanitary conditions depends on the customers following the rules. Of course, this does not always happen.

SUMMARY OF THE INVENTION

All of the many advantages of automatic vending and vending machines would appear to be highly desirable in the bulk vending context. An automatic bulk vending machine according to the present invention combines many of the benefits of automatic vending machines and manual bulk vending systems while addressing many of the problems and deficiencies of such machines and systems. Other aspects of the present invention relate to presently preferred methods and apparatus for easily loading items in bulk in a sanitary fashion, details of dispensing bulk items such as candy so that clogging or jamming are avoided, details of appropriate volumetric control of dispensing and details regarding ease of customer selection and effective product presentation to provide greater customer interaction and satisfaction with the machine.

By way of example, in one embodiment of the present invention, an automatic bulk vending machine for delivery to a customer of a customer selected blend from a plurality of products stored in bulk is provided. Such a machine may suitably comprise a plurality of bins to store products to be selected; a customer selection mechanism to enable the customer to select a blend of products; a dispenser mechanism responsive to the customer selection mechanism to dispense customer selected products; and a package mechanism operably connected to receive the customer selected products dispensed by the dispenser mechanism. The machine preferably provides the flexibility to alternatively vend a predetermined amount of total product at a predetermined price or to allow the customer to select the amount of overall product desired and to compute the price to be charged. As a result, a high degree of flexibility is provided to both the operator or owner of the machine and to customers. Improved dispensing equipment and customer interfaces are also provided.

The above-discussed features, as well as additional features and advantages of the present invention, will become more readily apparent by reference to the following detailed description and the accompanying drawings.

BRIEF DESCRIPTION OF THE DRAWINGS

FIGS. 8B–8M are detailed drawings of individual components of the dispenser of FIG. 8A;

DETAILED DESCRIPTION

Figure 1:
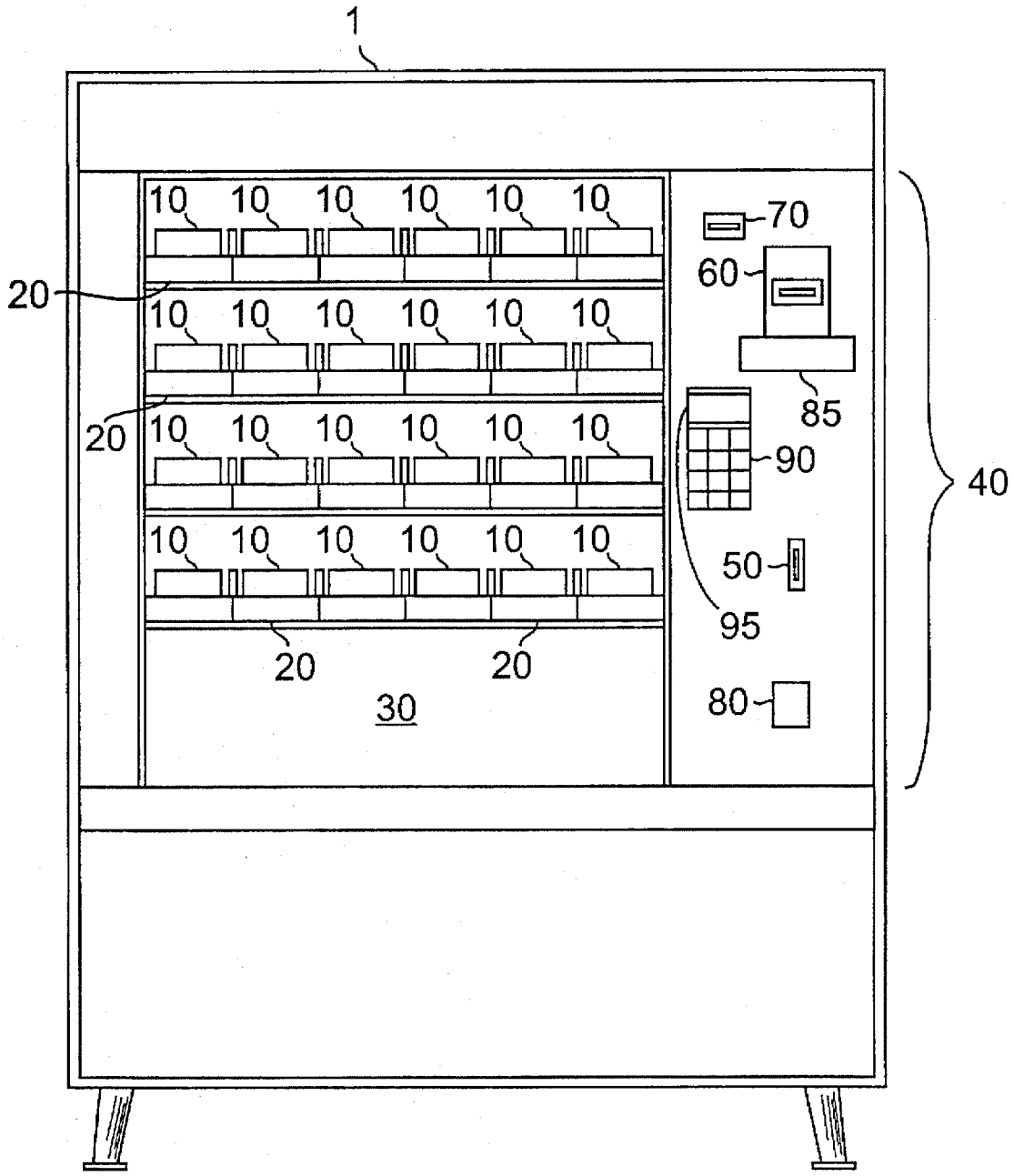
FIG. 1 PRIOR ART
FIG. 1 is a front view of a prior art automatic vending machine.

A prior art automatic vending machine 1 is shown in FIG. 1. As shown in FIG. 1, the vending machine 1 includes a variety of prepackaged products 10 to be dispensed. These products have a predetermined portion and makeup determined by their manufacturer and are stored in an area inaccessible to customers, such as behind a glass panel. Each product 10 is retained by a product delivery apparatus 20 which is selectively actuatable to dispense the product into a delivery area 30 that is accessible to the customer. Suitable product delivery apparatus 20 may include vend motors and solenoids which rotate helices which hold products between their spirals, as well as others well known in the art.

A control panel 40 of the vending machine 1 contains a coin slot 50 and a banknote or bill insert 60 which accepts currency to initiate a vend operation. The control panel 40 may also further contain a card acceptor 70 to enable customers to initiate a transaction with credit or debit cards. In addition, an electronic purse device in the form of a card may be inserted into the card acceptor 70 to initiate a transaction. The term "electronic purse" is used herein to denote a token or card possessing an electronic circuit, a magnetic strip or other data storing medium or circuity, for retaining a credit value of a particular currency. An electronic purse may be in one of a variety of shapes including a key, token or coin, as well as a card.

A coin return 80, a bill payout recess 85 and an item selector such as a keypad 90 are also provided in the control panel 40. A display 95 may suitably include dot-matrix displays, selectively activatable message lights or other displays capable of operating in the environmental conditions to which vending machines are typically exposed.

A customer may initiate a transaction by depositing a coin or bills of particular denominations in the slots 50 or 60, respectively. The customer may also insert an electronic purse device, or a debit or credit card in the card acceptor 70 to initiate a transaction. Once sufficient payment has been deposited in the automatic transaction system 1, the customer may select a product 10 to be dispensed using the keypad 90. The corresponding product delivery apparatus 20 will then dispense the selected product 10 to the product delivery area 30 where it may be retrieved by the customer. Any resulting change from the transaction may be paid out through the coin return 80, the bill payout recess 85 or credited to an inserted card or electronic purse device.

Figure 2:
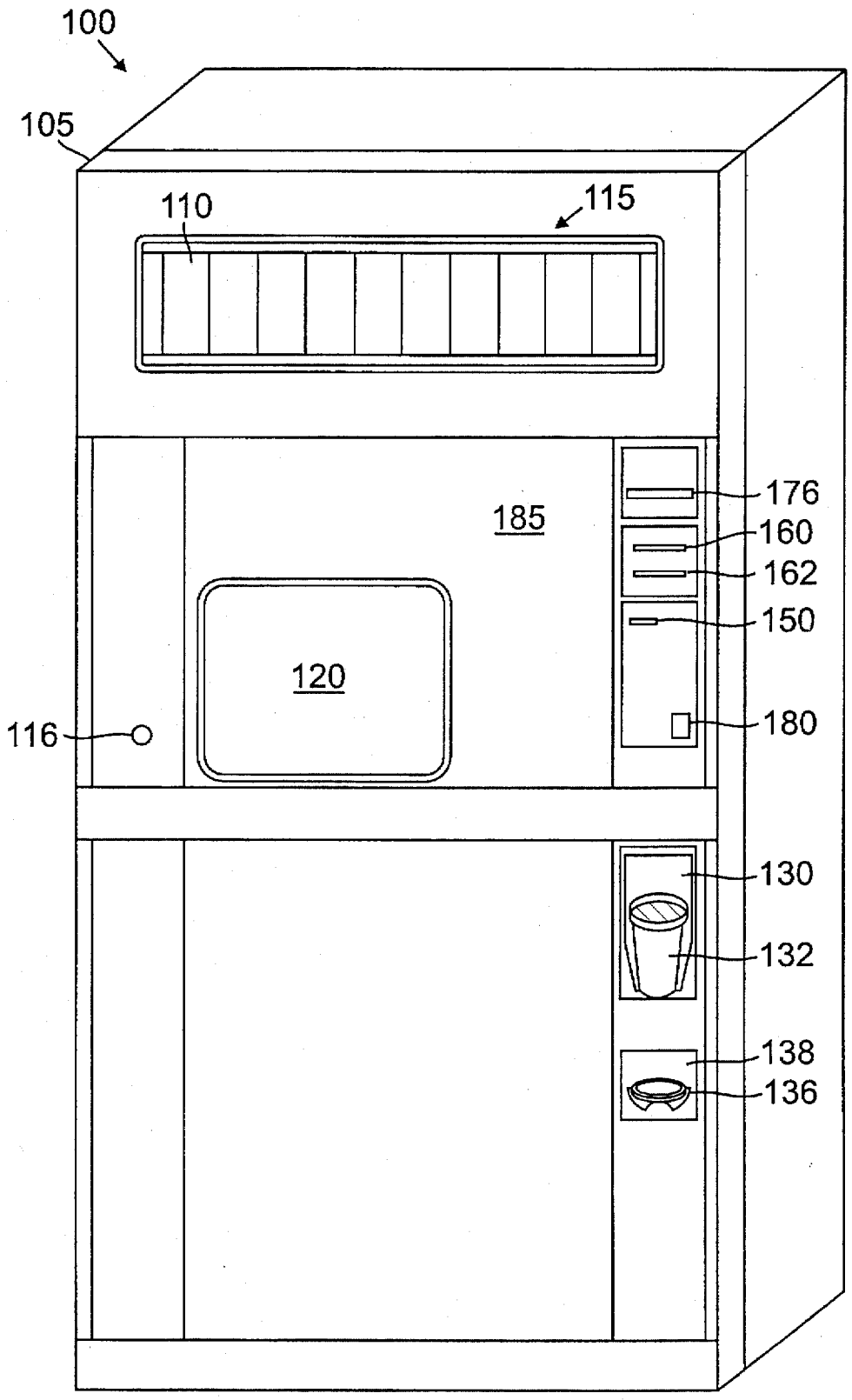
FIG. 2 is a front view of an automatic bulk vending machine according to the present invention.
Figure 3:
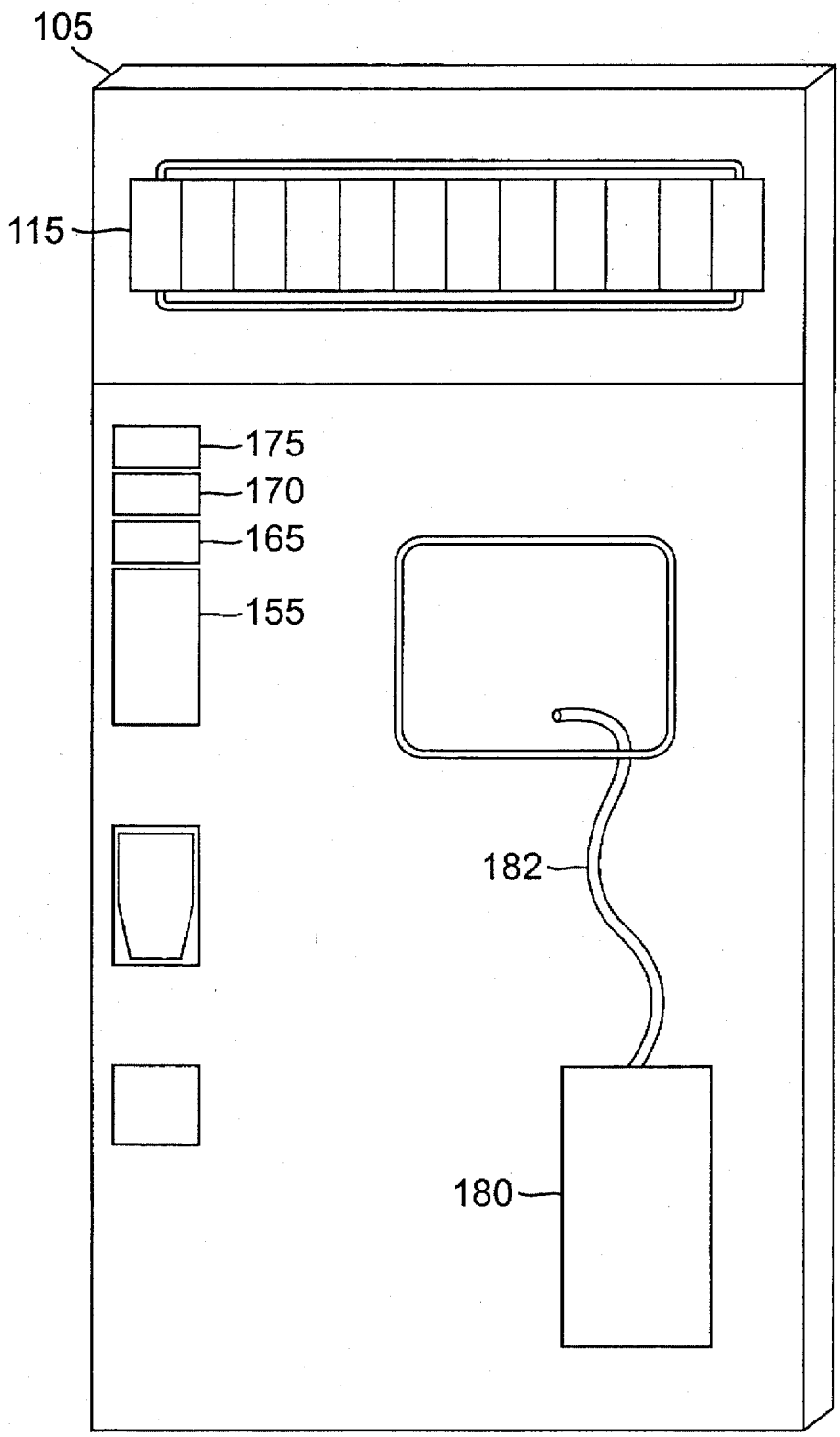
FIG. 3 is a front view of the inside of the front door of the vending machine of FIG. 2 showing various components that may be suitably mounted thereon.

While it is anticipated that the present invention may be adapted to machines such as the one illustrated in FIG. 1 by replacing their physical product delivery structure as will be discussed further below, a presently preferred automatic bulk vending ("ABV") machine 100 according to the present invention is shown in FIG. 2. The ABV machine 100 stores products 110 in bulk inside the machine. In a presently preferred embodiment, samples of the products 110 are shown in a rotating product display 115. This display 115 may automatically rotate to display the products to be dispensed or may rotate in response to customer activation of an optional control switch 116, or activation of a combined touch-activated product selector and display or touch-screen 120. While the rotating product display 115, as described in greater detail below in connection with FIG. 3, is presently preferred, a fixed display may also suitably be employed. Alternatively, no display of actual product is necessary if a lower cost machine is desired. The front of the ABV machine 100 illustrated in FIG. 2 also includes a product delivery area 130, a coin slot 150, a banknote or bill insertion slot 160, a coin return 180, and a fiber-optic sign or display 185. The display 185 operates to advertise the products to be vended and to engage the interest of customers.

In operation, a customer approaches the ABV machine 100, operates and interacts with the touch-screen 120 to make a selection as described in greater detail below, and inserts money into the coin or banknote slots 150 or 160 to pay for the selection. The money is validated and if sufficient money has been inserted, a cup 132 is dropped into the product delivery area 130 and the customer's selection is fed into the cup 132. The customer takes the cup 132 and a lid 136 from a lid dispenser 138. If any change is due, it is returned to the customer at the coin return 180, at the bill insertion slot 160, from an optional bill payout recess 162, or from a combination of such sources. Alternatively, credit may be obtained utilizing a credit card, debit card or electronic purse inserted in an optional card reader slot 176, and any change may then be credited thereto.

As shown in FIG. 3 which illustrates the inside of a front door 105 of the machine 100, a number of components such as the rotating product display 115, a coin changer or coin mechanism 155, a bill validator or currency mechanism 165, an optional bill payout mechanism 170 for making change, an optional card reader 175, and a fiber-optic projector 180 are preferably mounted on the inside of the front door 105 of the ABV machine 100. The fiber-optic projector 180 is connected to the fiber-optic display 185 by a fiber-optic bundle 182. Suitable components for projector 180, bundle 182 and display 185 may be obtained from suppliers, such as Fiberoptic Lighting Inc. The front door 105 swings open to give easy access to the inside of the machine 100 and to the components mounted therein. While a variety of coin mechanisms and bill validators might suitably be used, in a presently preferred embodiment, a Mars Electronics model TRC-6800 combination bill acceptor and coin changer is employed. A presently preferred construction for the rotating product display 115 includes a plurality of Lexan containers for holding the product samples. The containers are carried by a chain drive which is driven by a drive motor. This motor may suitably be a Power Moller motor from Itoh Electric Co. Ltd. A pair of sprockets are also included at both ends.

Figure 4:
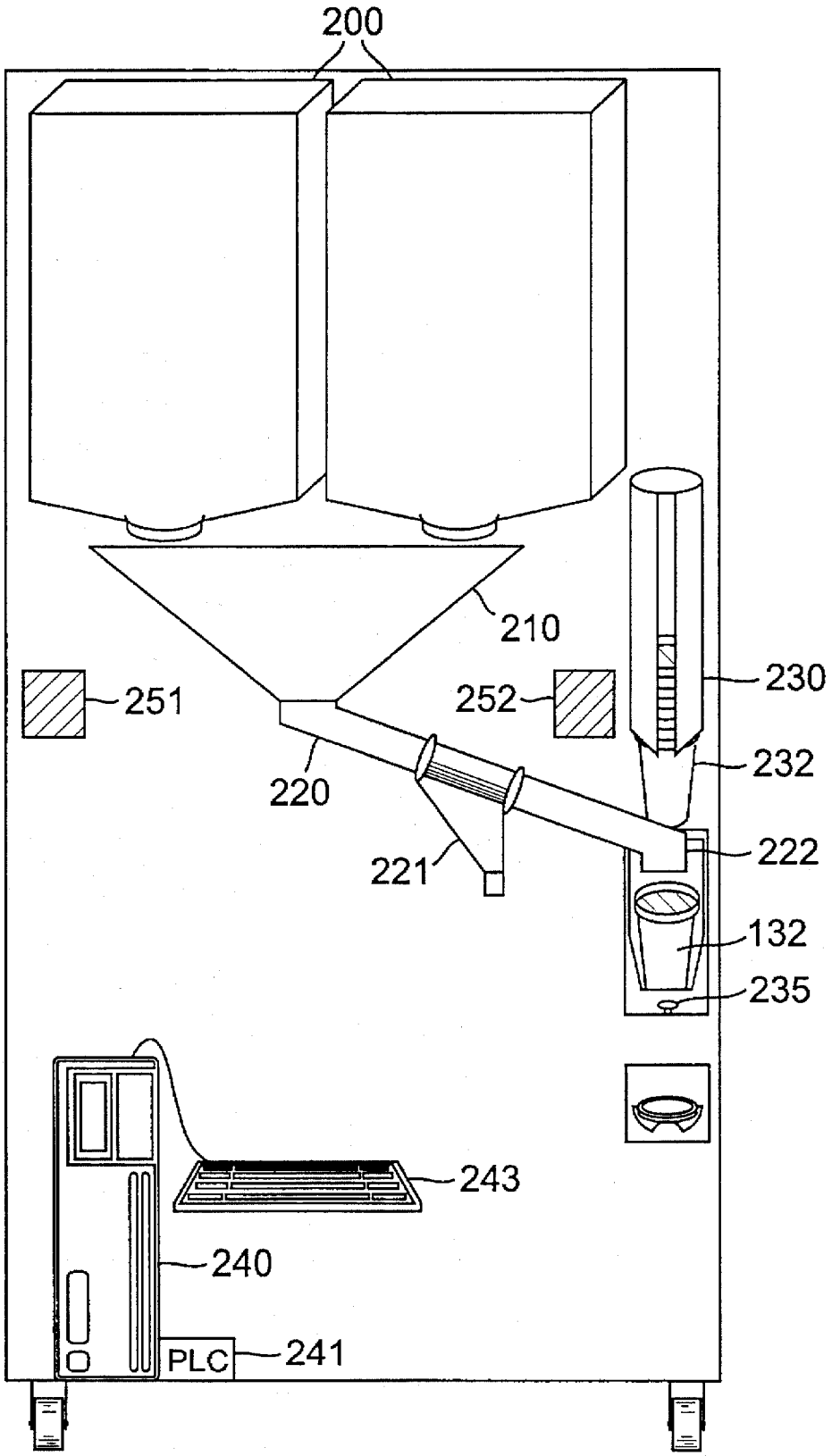
FIG. 4 is a perspective view of the vending machine of FIG. 2 with its front door and its touch-screen removed.

FIG. 4 shows a front view of the ABV machine 100 with its front door 105 and touch-screen 120 removed. As seen in this figure, a plurality of bins 200 store the products 110 to be vended. As discussed further below, products from the bins are collected in a blending and holding pan or hopper 210 from which they are then released into a dispenser tube 220 which directs the blended product to an exit 222 where it is fed into the cup 132.

As also shown in FIG. 4, the machine 100 also includes a cup dispenser 230 which stores a plurality of additional cups 232. One suitable cup dispenser for use as the dispenser 230 is the Maxiframe Cup Dispenser for 28 ounce cups from Lisern Enterprises, Inc. While FIG. 4 shows a single cup dispenser, it is contemplated that an additional cup dispenser or dispensers could be employed to add a greater inventory of cups or to have different cup sizes. Further, while the mechanism shown and described is the presently preferred package mechanism for packaging the dispensed products, other package mechanisms might also be employed, particularly if a higher cost machine 100 were envisaged. A fiber-optic cup sensor 235 is also preferably included to sense when a cup, such as the cup 132 is or is not correctly positioned so that product can be dispensed without spilling.

In a presently preferred embodiment, the machine 100 also includes a computer or control electronics 240 which in conjunction with a programmable logic controller or PLC 241 controls the vending operation, the touch-screen 120 and a pair of audio speakers 251 and 252, as discussed further below. An optional keyboard 243 is also shown in FIG. 4. A presently preferred program listing and cross reference file are attached as Appendices A and B hereto.

Figure 5:
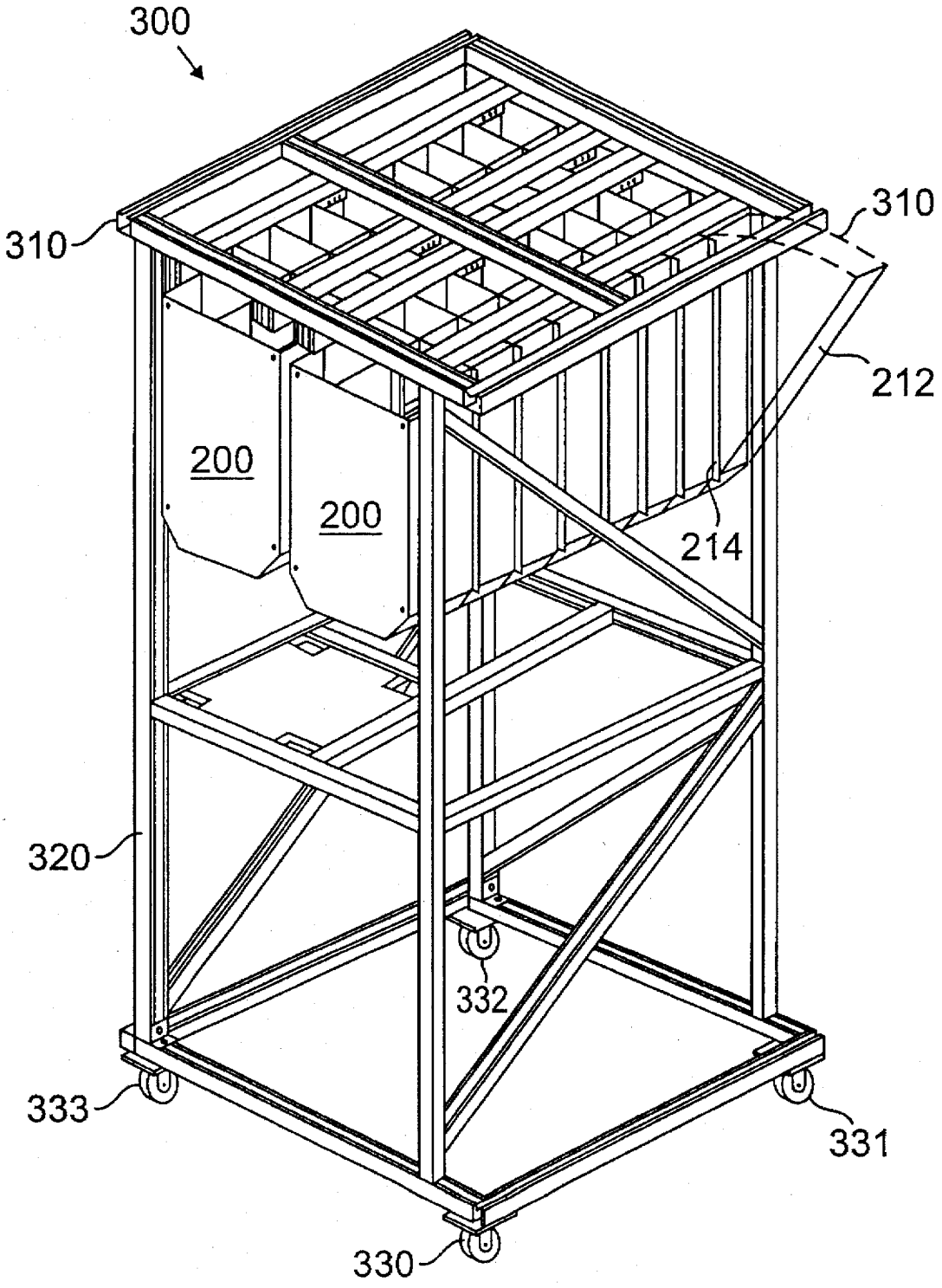
FIG. 5 is a perspective view illustrating one suitable apparatus for mounting a plurality of bulk vending containers or bins to facilitate easy refilling of the bulk vending machine of FIG. 2.

Before turning to further details of the electronics for the machine 100, additional mechanical aspects are addressed in conjunction with a discussion of FIGS. 5–10. As shown in FIG. 5, in a presently preferred embodiment, the bins 200 are mounted on a trolley assembly 300 which can be slideably moved on rails or guides 310 out of the machine 100 when the door 105 is opened. With this arrangement, the bins 200 can be readily and rapidly refilled without risk of tipping over the machine 100. As further seen in FIG. 5, the trolley 300 also preferably includes a heavy duty frame 320 and wheels 330–333.

In one presently preferred embodiment of the invention, there are 36 bins 200. If each bin when full contains 12 pounds of an item, such as plain "M&M's", "M&M's" is a registered trademark, chocolate candies, the total weight stored by the machine is 432 pounds. As a result, it is important to prevent tipping. While the present application shows and describes one suitable method to prevent tipping and allow ready access to the bins 200, other approaches may be readily implemented consistent with the overall size of the machine, its environment, and the weight of product to be stored in bulk.

Figure 6:
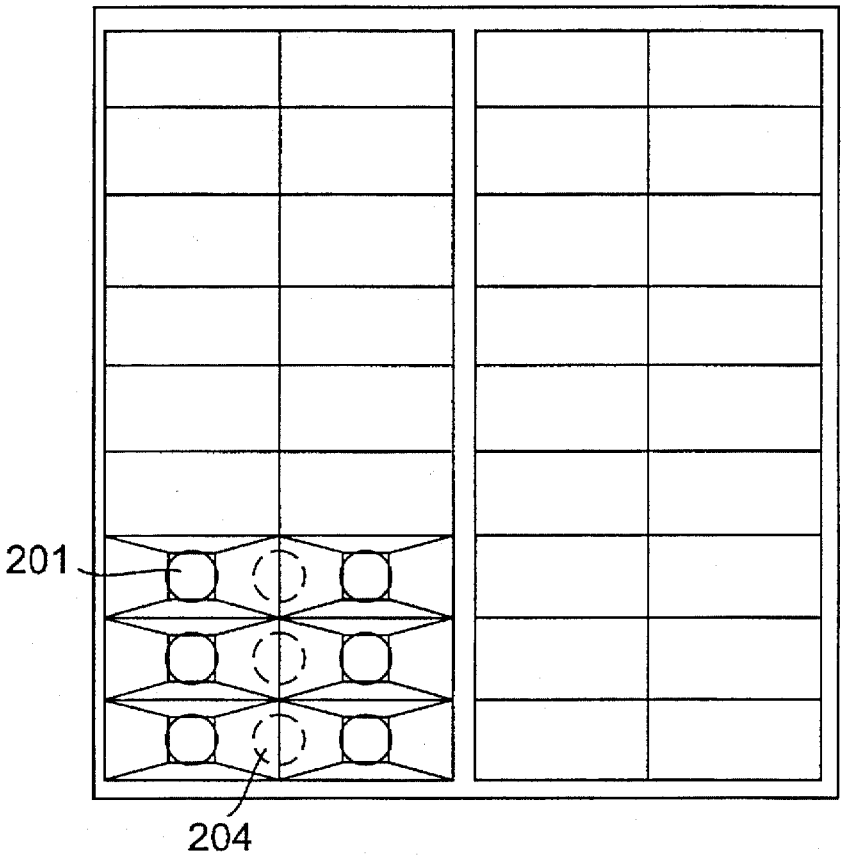
FIG. 6 is a top view of one suitable arrangement for arranging a plurality of bins for holding items to be vended by the bulk vending machine of FIG. 2.

As shown in FIG. 6, 36 bins 200 are employed with 18 bins on the left-hand side and 18 bins on the right-hand side. At the bottom of each bin 200 is a hole 201. This hole allows product to pass from the bin 200 to a volumetric shuttle or dispenser 400 shown in FIGS. 8A–8M and described further below. The dispenser 400 moves a predetermined volume of product above a second hole 204. The product then falls through the hole 204 and into the hopper 210.

Figure 7:
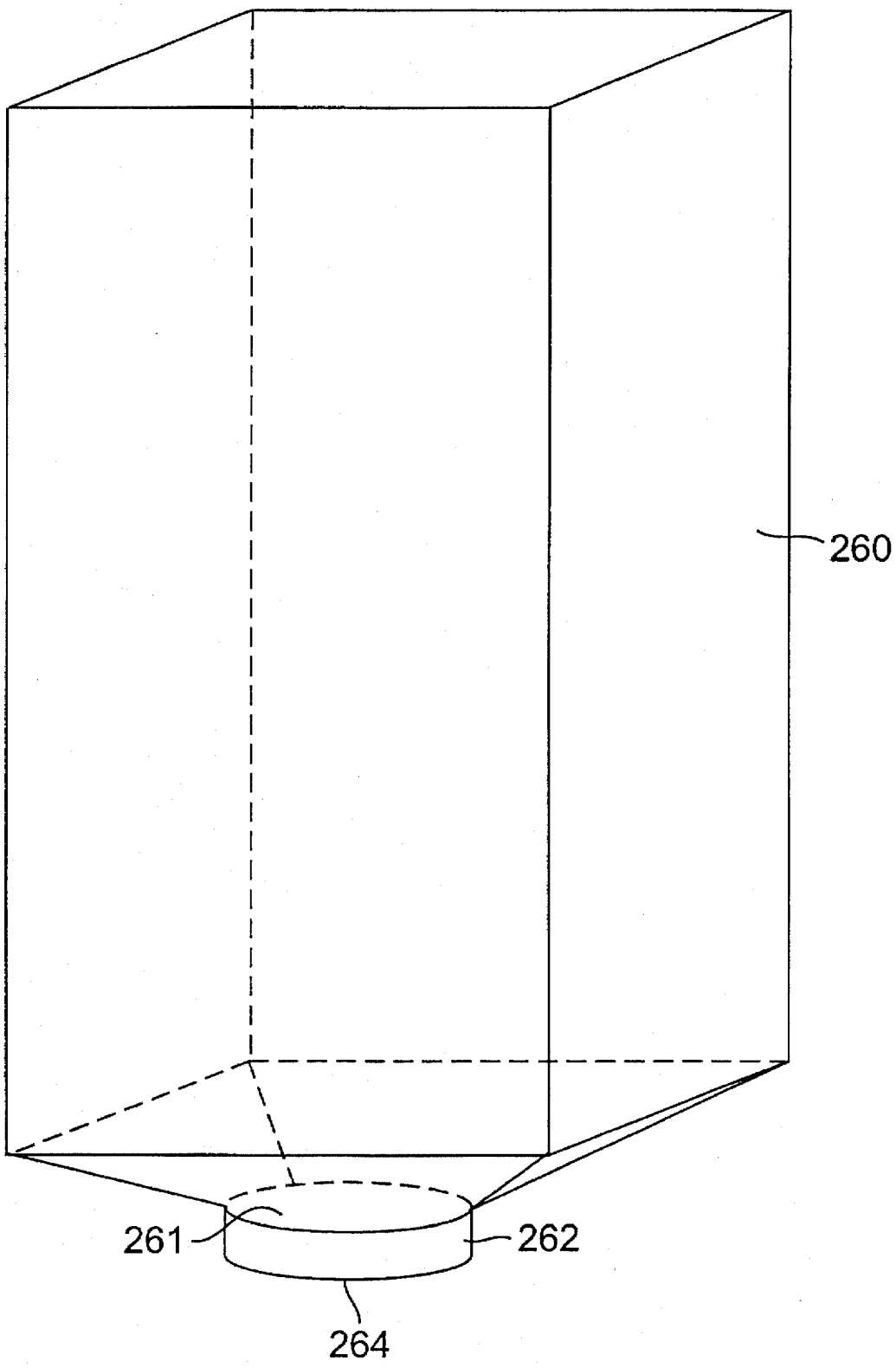
FIG. 7 is a perspective view of a refill container for snap in sanitary refilling of the bins of FIGS. 5 and 6.

In a presently preferred embodiment, the bins 200 of FIGS. 5 and 6 are readily first filled and then refilled utilizing a plastic refill container which is filled and sealed in the factory. One such suitable container 260 is shown in FIG. 7. The container is simple to snap in place inside the bins 200. The use of refill containers 260 facilitates the sanitary handling of products to be vended by eliminating human handling of the product during loading of the machine 100.

Figure 6A:
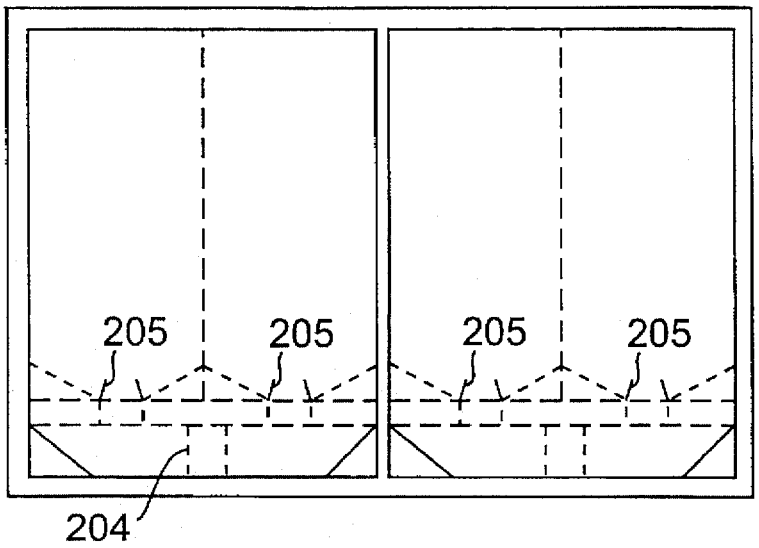
FIG. 6A is a side view of the bins of FIG. 6.

To load a bin 200, its end panel 212, best seen in FIG. 5, is tilted open about a hinged axis 214. An empty container 260 is then removed and the factory-fresh refill container 260 is placed in its stead. Each container 260 has an opening 261 in its base which terminates in a lower neck portion 262 having an outer diameter that will fit within the inner diameter of the hole 201 located in the base of each of the bins 200. As the container 260 is inserted into bin 200, a sealed membrane 264 across the bottom of the opening 261 is preferably pierced by a sharp, upwardly extending surface such as a flange or teeth 205 as illustrated in FIG. 6A.

Figure 8A:
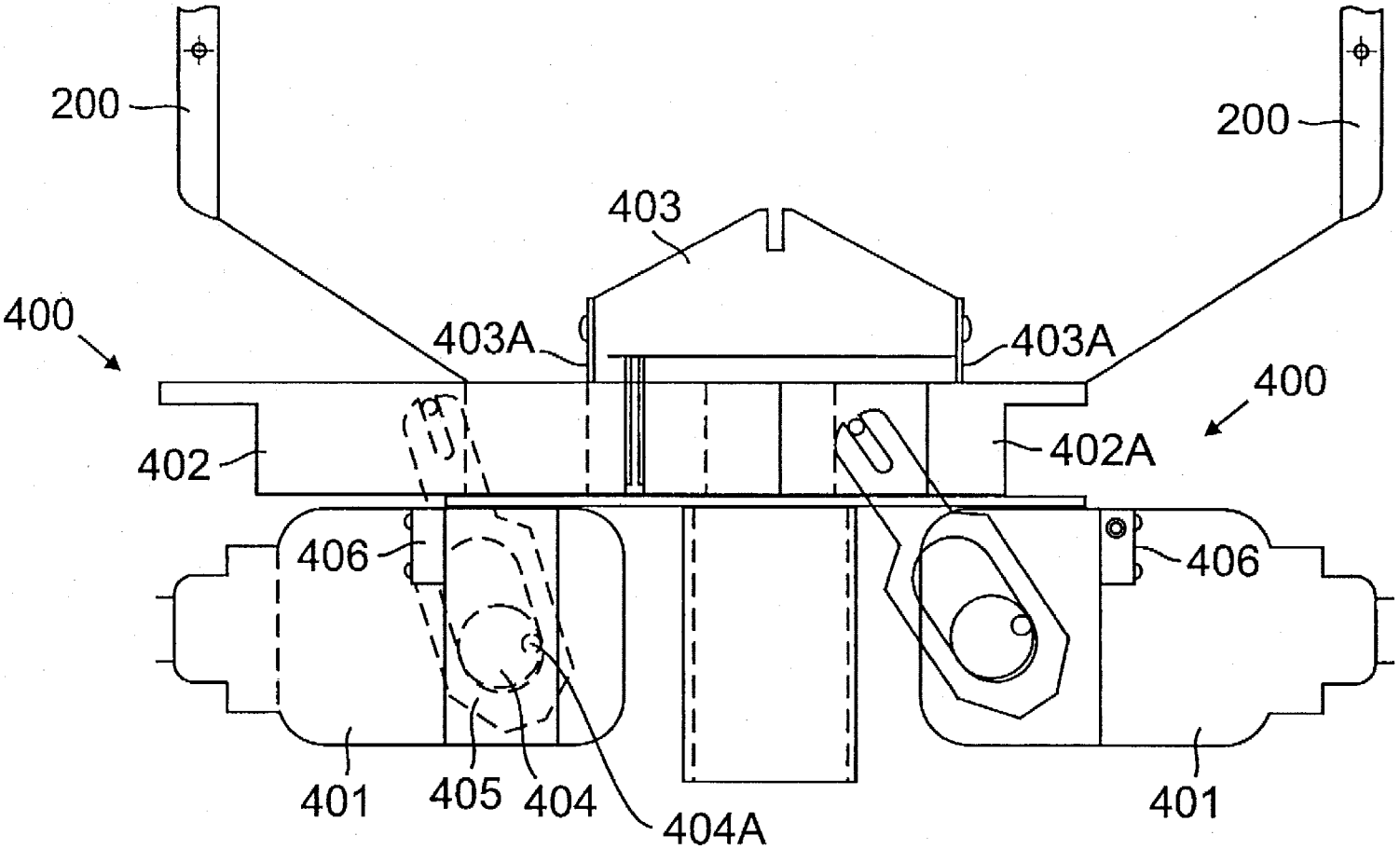
FIG. 8A is a front overall view of a volumetric shuttle or dispenser for volumetrically dispensing products from the bins of FIGS. 5 and 6.

The dispensers 400 are illustrated in FIG. 8A. In the presently preferred embodiment, each of the bins 200 has an associated dispenser 400. It is recognized, however, that other arrangements may employ a lesser number of dispensers.

Figure 11:
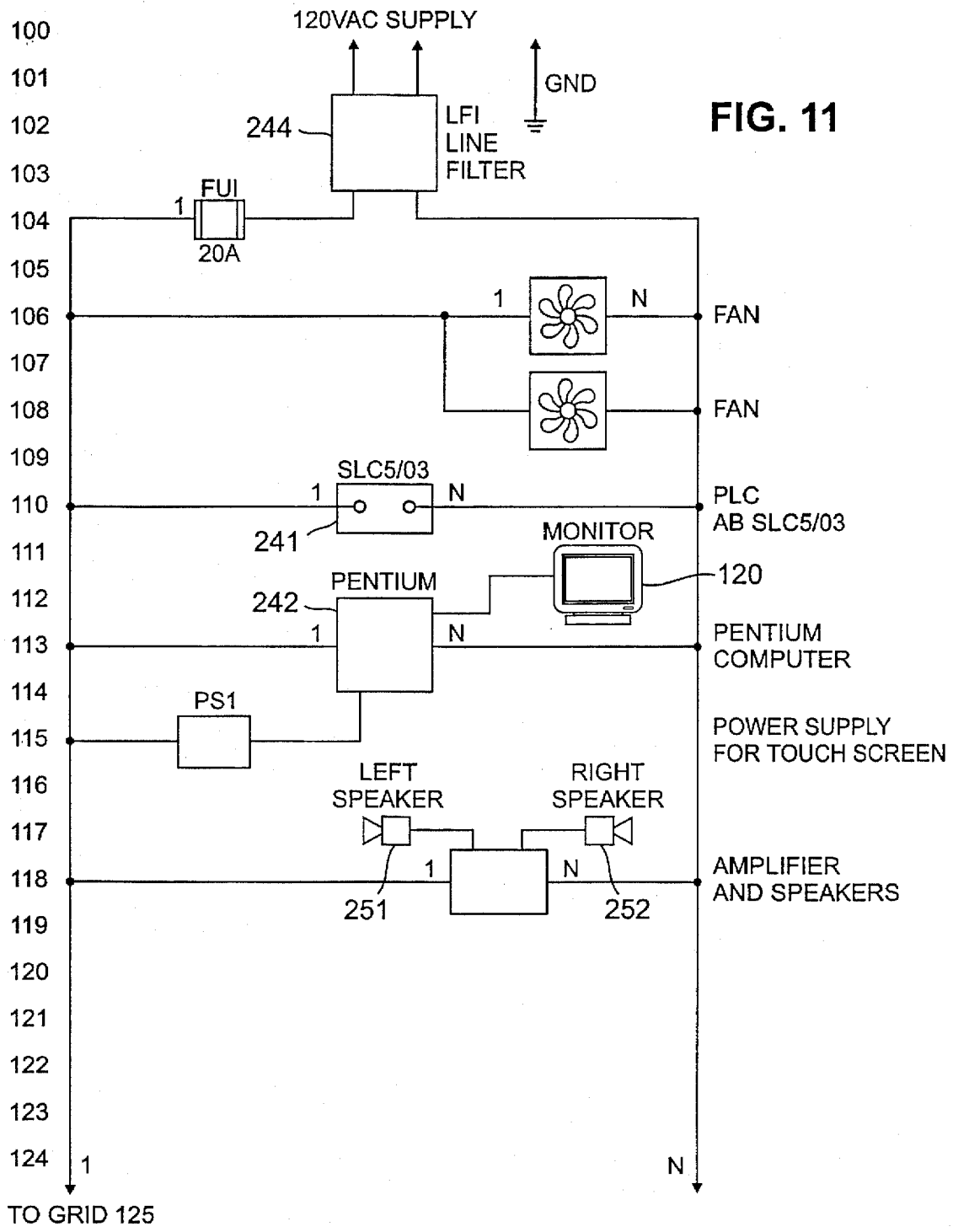
FIGS. 11–20 are electrical schematics illustrating aspects of one suitable electrical system for the vending machine of FIG. 2.

In FIG. 8A, two bins and two dispensers are shown. Each of the dispensers 400 is controlled by the programmable logic controller or PLC 241 which may suitably be an Allen-Bradley model number SLC 5/03 PLC. Color and quantity information is input by the customer using the touch-screen 120 which may suitably be formed by combining a Digital Equipment Corporation model number VSXTA-AA DECTouch Sensing Platen with a model number FR-PCXAV-HA DEC 21 Inch Computer Monitor. The customer selection data is passed from the computer 240 to the PLC 241. In a presently preferred embodiment, the computer 240 may suitably be a Digital Equipment Corporation Model Number FR-783AA-WN Pentium XL 590 PC. Both the computer 240 and the PLC 241 are shown in FIG. 11 and discussed further below.

A discrete output from the PLC 241 starts the action by causing a motor 401 to move a volumetric cup 402 beneath the hole 204 for the selected product 110. One suitable motor for use as the motor 401 is an ECM Mini 120V motor. The product drops from the hopper and fills the volumetric cup 402. This position is referred to as the outstroke position of the dispenser. Inside the base of each hopper or bin is a wiper 403 made of polypropylene used to level the product in the volumetric cup 402. On each end of the wiper 403 is attached a squeegee 403A. This wiper 403 and squeegee 403A, and the shape of the volumetric cup 402 prevent or substantially reduce damage to the candy. The dispenser 400 also supplies an accurate, repeatable fill quantity.

To dispense product to the hopper 210, the motor 401 is energized by an output from the PLC 241. The motor 401 then rotates a cam 404 in a counterclockwise motion, moving an actuator arm 405 over a proximity sensor 406. In a presently preferred embodiment, approximately 1 ounce of product is then moved from the hopper to the center drop point over hole 204 so that product is discharged to the blending pan or hopper 210. It will be recognized that other volumes may be readily dispensed by proper selection or adjustment of the cup size. By way of example, a large cup size may be readily reduced by inserting a smaller insert cup.

The dropping point for the candy is at ½ cycle. The right volumetric cup labeled 402A in FIG. 8A is in the drop position. The return stroke is the completion of the cycle. When the actuator arm returns to its "home" or outstroke position seen in the lefthand portion of FIG. 8A for cup 402, its position is sensed by the proximity sensor 406 which sends a signal to the PLC 241 indicating the completion of one stroke or cycle. The PLC 241 has a preset count for the full amount of candy to be dispensed. For example, if the volumetric cup 402 dispenses one ounce per cycle and the customer wants six ounces of red plain "M&M's" chocolate candies, the PLC 241 will store a count of six for red plain "M&M's" chocolate candies. It will then receive a signal every time the proximity switch 406 for that particular color is activated, and count up to six before finally returning the actuator arm 405 to its home position and stopping its motor 401.

Multiple drops of 1 ounce of candy can be performed simultaneously by using one motor per color or a clutch engager/disengager assembly with a single motor arrangement for multiple colors.

After all the candy selected by the customer has been dropped into the blending pan 210 and a signal is received from the PLC 241, a cup is dropped by the cup dispenser 230 and sensed by sensor 235, the gate 219 is opened. As the candy travels from the hopper 210 to the cup 132, it passes over separated rods designed to separate the fines or breakages of candy before entering the cup. As discussed below, a 25 degree angle is desirable for the blending pan surfaces and the tube containing the separating rods to allow candy to drop without the use of vibration or other impacting. Alternatively, a vibrator or other impact source can be used to insure complete vending and to avoid jamming and sticking. With items having a higher coefficient of friction than plain "M&M's" chocolate candies, it may be desirable to include a vibrator.

Figure 8B:
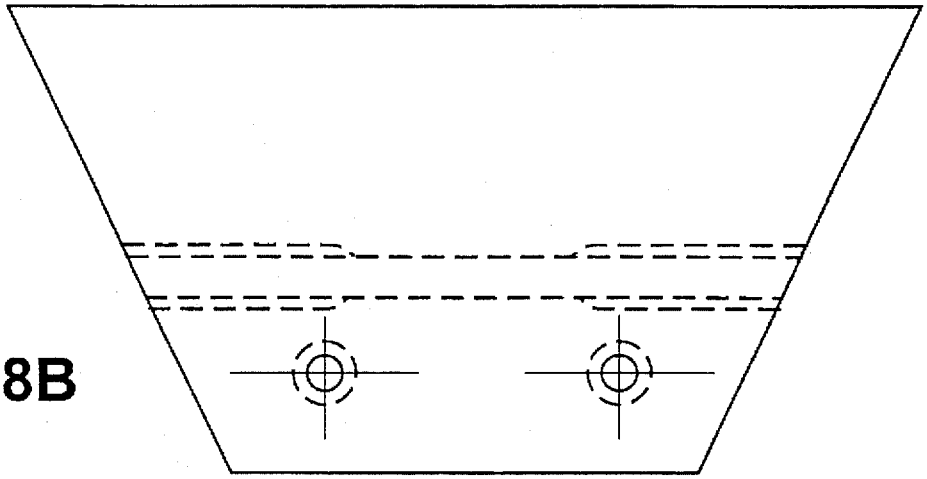
Figure 8C:
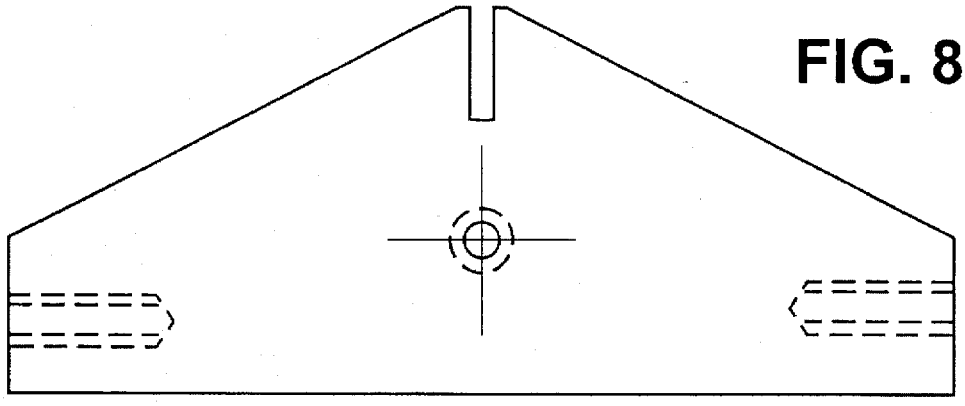
Figure 8G:
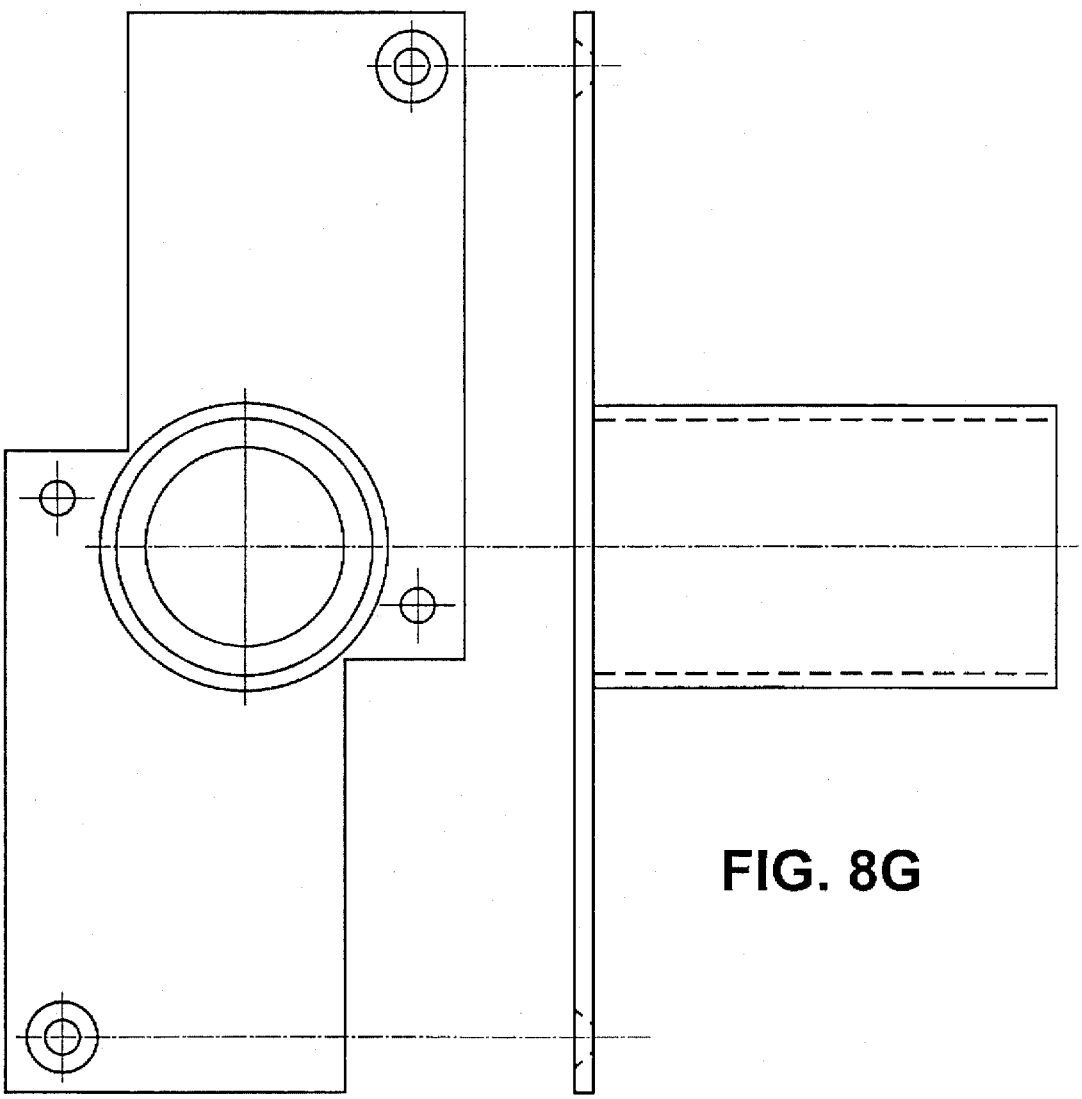

FIGS. 8B and 8C show two detailed views of the polypropylene wiper 403 of FIG. 8A. FIG. 8D illustrates further details of the squeegee 403A of FIG. 8A which may suitably be constructed of food grade polyethylene. FIGS. 8E and 8F illustrate further details of the cam 404 and its shaft 404A. FIG. 8G shows additional details of the volumetric cup discharge chamber.

Figure 8H:
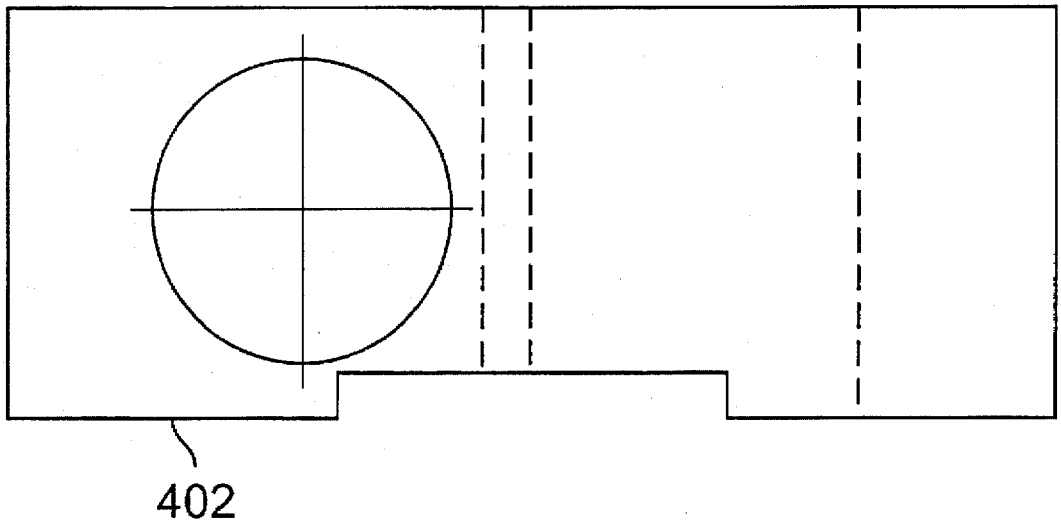
Figure 8I:
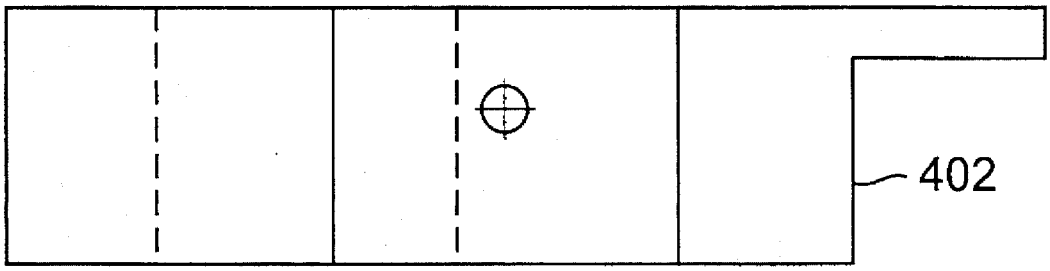
Figure 8J:
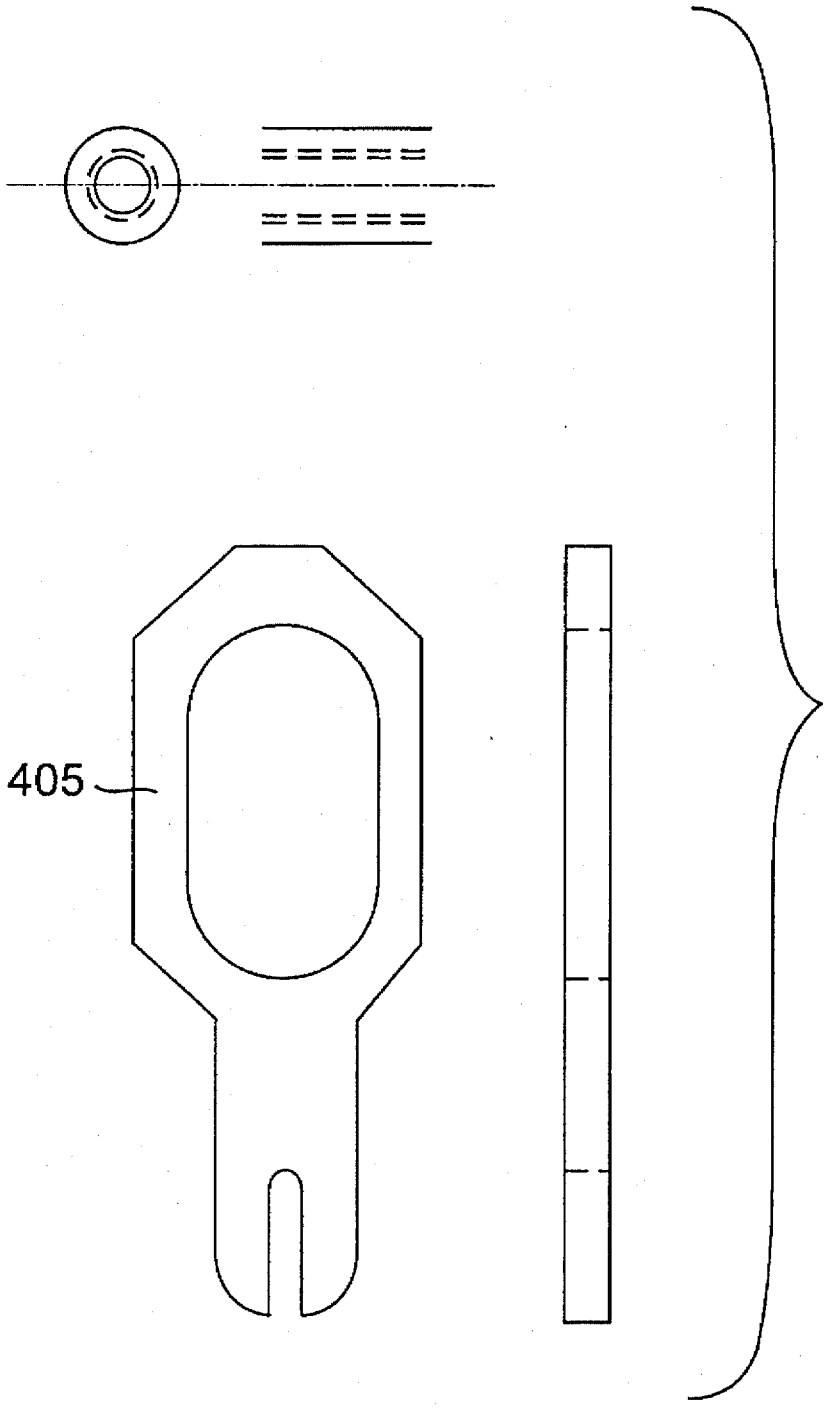
Figure 8K:
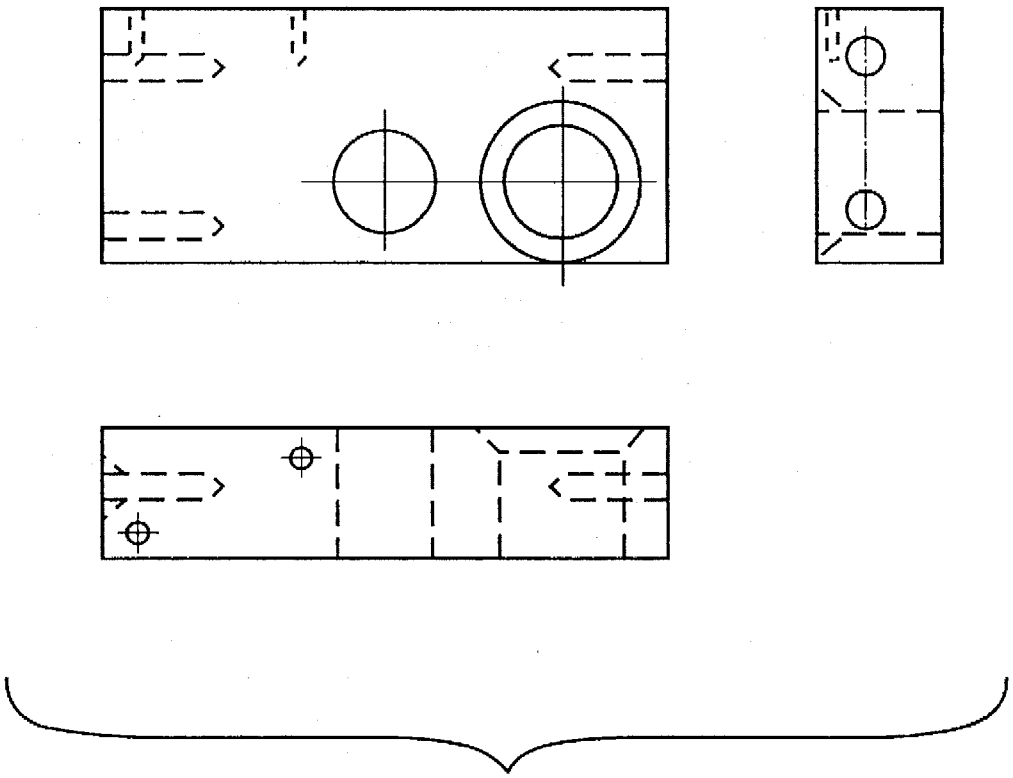
Figure 8L:
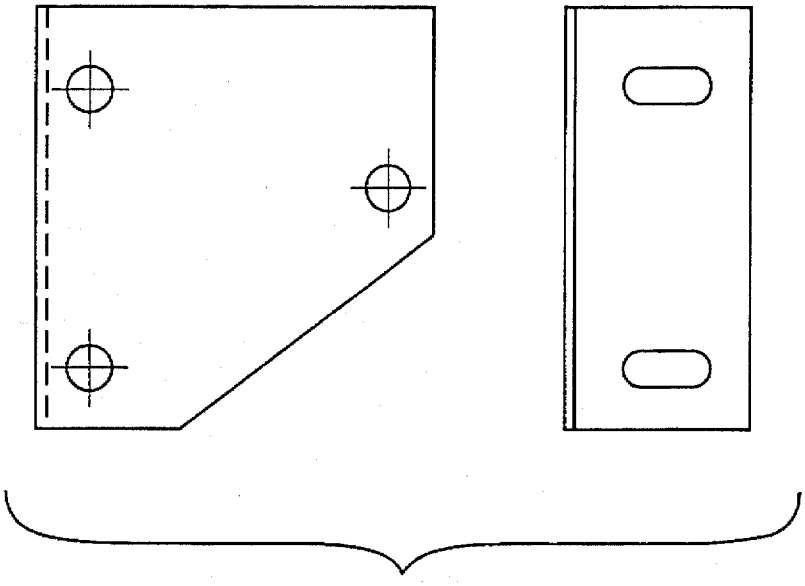
Figure 8M:
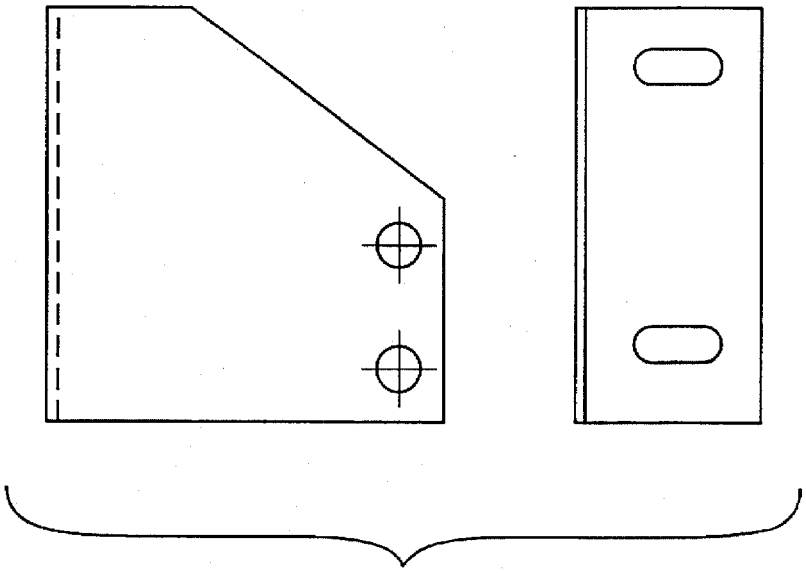

FIGS. 8H and 8I show additional details of the volumetric cup 402 of FIG. 8A. Cup 402 may suitably be made of high density polyethylene. FIG. 8J shows further details of the actuator arm 405 of FIG. 8A. Finally, FIG. 8K and FIGS. 8L and 8M show in detail arm and cam mounts to motor brackets, and motor brackets, respectively.

Figure 9A:
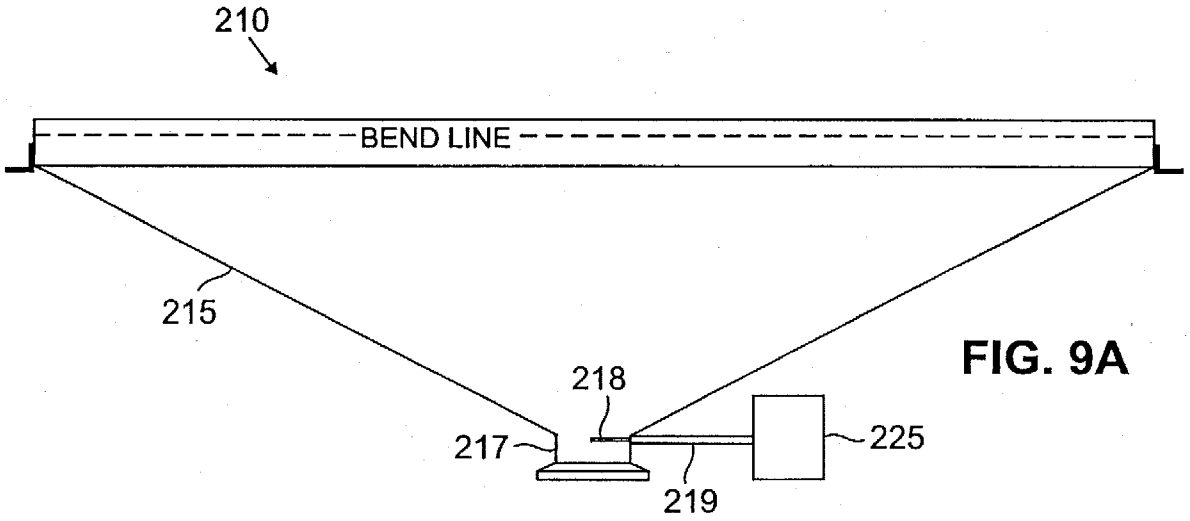
FIGS. 9A and 9B are front views illustrating a blending and holding pan or hopper for collecting, mixing, holding and further directing items dispensed from the bins of FIGS. 5 and 6.
Figure 9B:
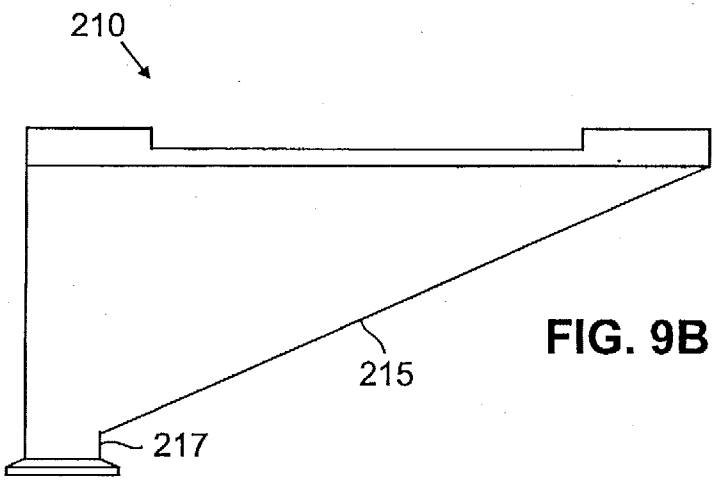

FIGS. 9A and 9B illustrate further details of the presently preferred hopper 210 for use with products such as plain "M&M's" chocolate candies. The preferred hopper 210 is fabricated by bending stainless steel sheet metal to form an upper pan 215 and welding its base to a stainless steel tri-clover ferrule 217. It has been determined that a minimum pitch $\alpha$ of approximately 25° is desirable to allow complete flow of product without stoppage of the product.

As shown in FIG. 9A, a slot 218 is cut in the ferrule 217. This slot 218 allows a dispensing gate 219 to be controllably inserted and removed from the ferrule 217 to controllably block and open the hopper 210 for dispensing. The dispensing gate 219 is controllably moved by a solenoid or motor 225. When the gate 219 is inserted, product can be dispensed from the bins 200 into the hopper 210 where it is partially blended and held. After all of the items selected by the customer have been delivered to the hopper 210, the gate 219 is removed by activating the motor 225 and the product is then fed by gravity from the hopper 210 to and through the dispenser tube 220 to the customer's cup 132. As the product falls out of the hopper 210, the mixing of product continues so that the end product is nicely mixed. Where colorful products such as plain "M&M's" chocolate candies are vended, the end mixture is particularly colorful and pleasing to the eye.

The hopper 210 may be mounted so that it can be readily slid out from beneath the bins 200 so that it can be cleaned and maintained in a properly sanitary condition. The preferred stainless steel surface tends to stay clean; however, a removable and disposable liner may also be used.

Figure 10A:
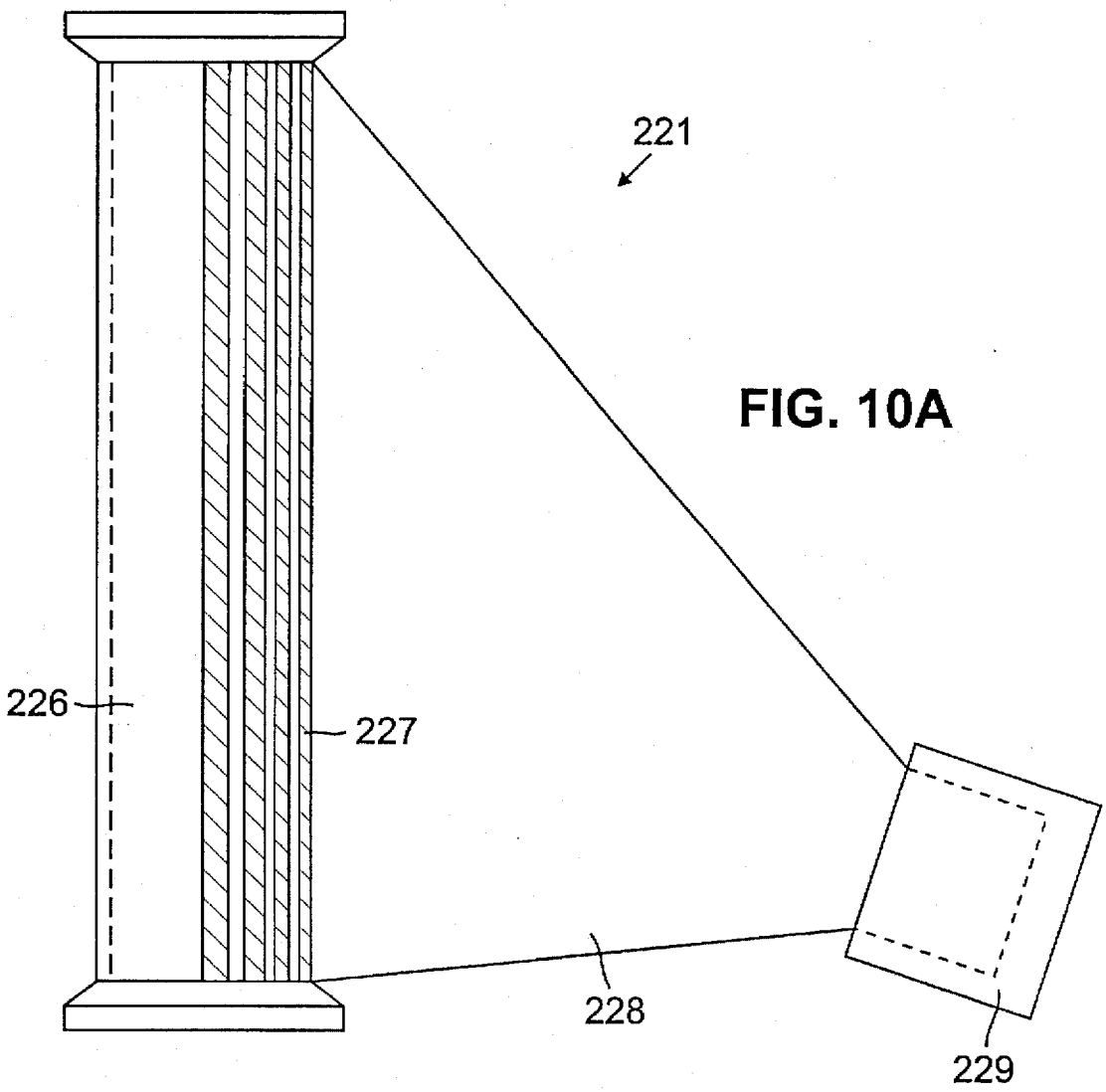
FIG. 10A is a front view of a portion of a presently preferred transport tube for eliminating broken candy as they are delivered from the hopper of FIGS. 9A and 9B to a customer.
Figure 10B:
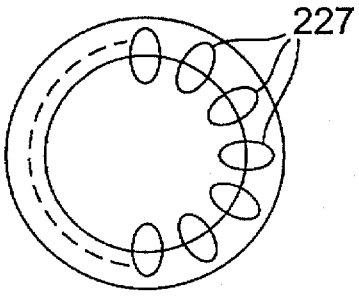
FIG. 10B is a cross-sectional view of the portion of the transport tube shown in FIG. 10A.

As product travels from the hopper 210 to the cup 132, it travels through a portion of the dispenser tube 220 constituting a fines separator and collector 221 which is illustrated in FIGS. 10A and 10B. In a presently preferred embodiment, it is highly desirable that the end product delivered to the customer be visually appealing and not include large amounts of small broken pieces, or chips, also known as "fines". To this end, the fines separator and collector 221 is included to separate out fine pieces resulting from breakage and the like. The separator and collector 221 comprises a tubular separator 226 and a collector 228 including a removable cup 229 which can be emptied during the course of routine maintenance of the machine 100. The bottom portion of the tubular separator 226 is comprised of a series of spaced rods 227. The spacing of the rods 227 determines how fine the separated pieces will be. For plain "M&M's" chocolate candies, it has been found that a spacing of ¼ inch is satisfactory.

Electronics And Interactive Display Features

Turning to the presently preferred electronics for use in an automatic bulk vending machine 100 according to the present invention, these electronics are illustrated in the electrical schematics of FIGS. 11–20 respectively. Software is contained in Appendices A and B hereto.

As shown in FIG. 11, the computer 240 seen in FIG. 4 will preferably include a pentium processor 242 for monitoring and controlling the touch-screen or monitor 120. The processor 242 provides customer selection information to the PLC 241, and controls the left and right speakers 251, 252. Power is preferably provided from a 120 VAC supply through a line filter 244.

Figure 12:
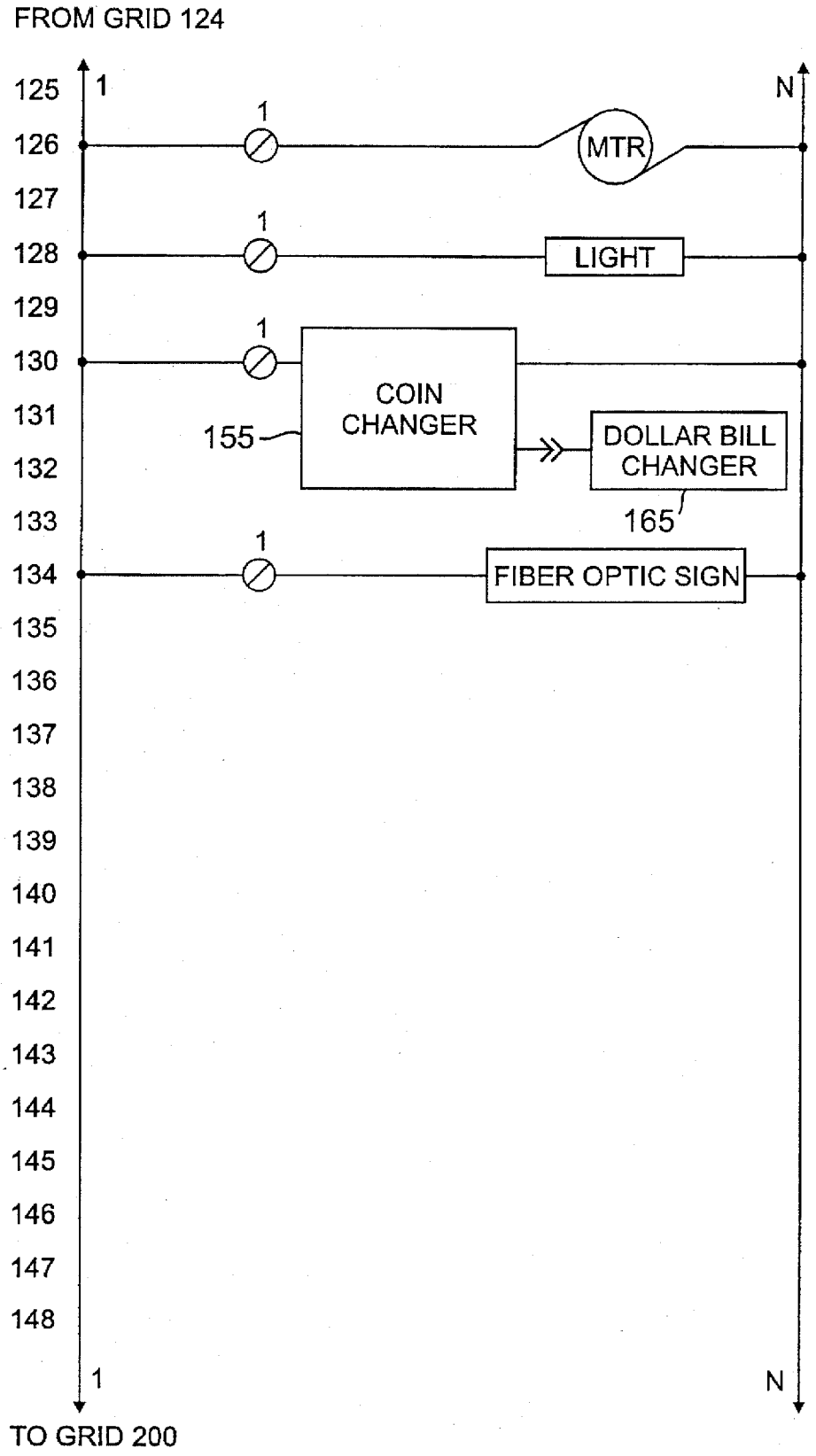

As illustrated in FIG. 12, a motor MTR 115A which drives the rotating product display 115 and a light 115B which lights the display 115 are also connected to line power. The coin changer 155 and the dollar bill changer or validator 165 as well as the fiber optic sign 185 are also connected to line power through the line filter 244. They are also controlled by the PLC 241.

Figure 13:
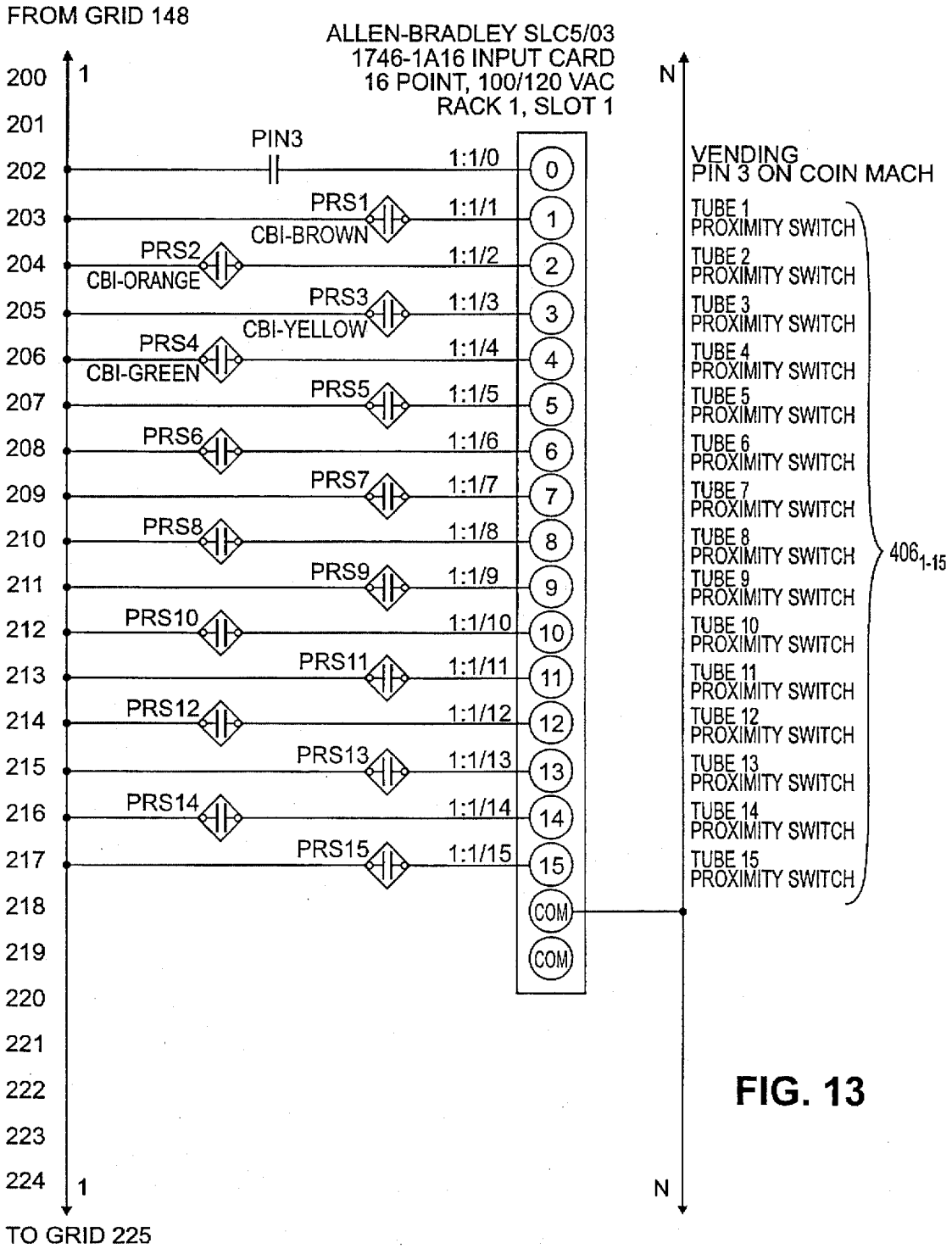
Figure 14:
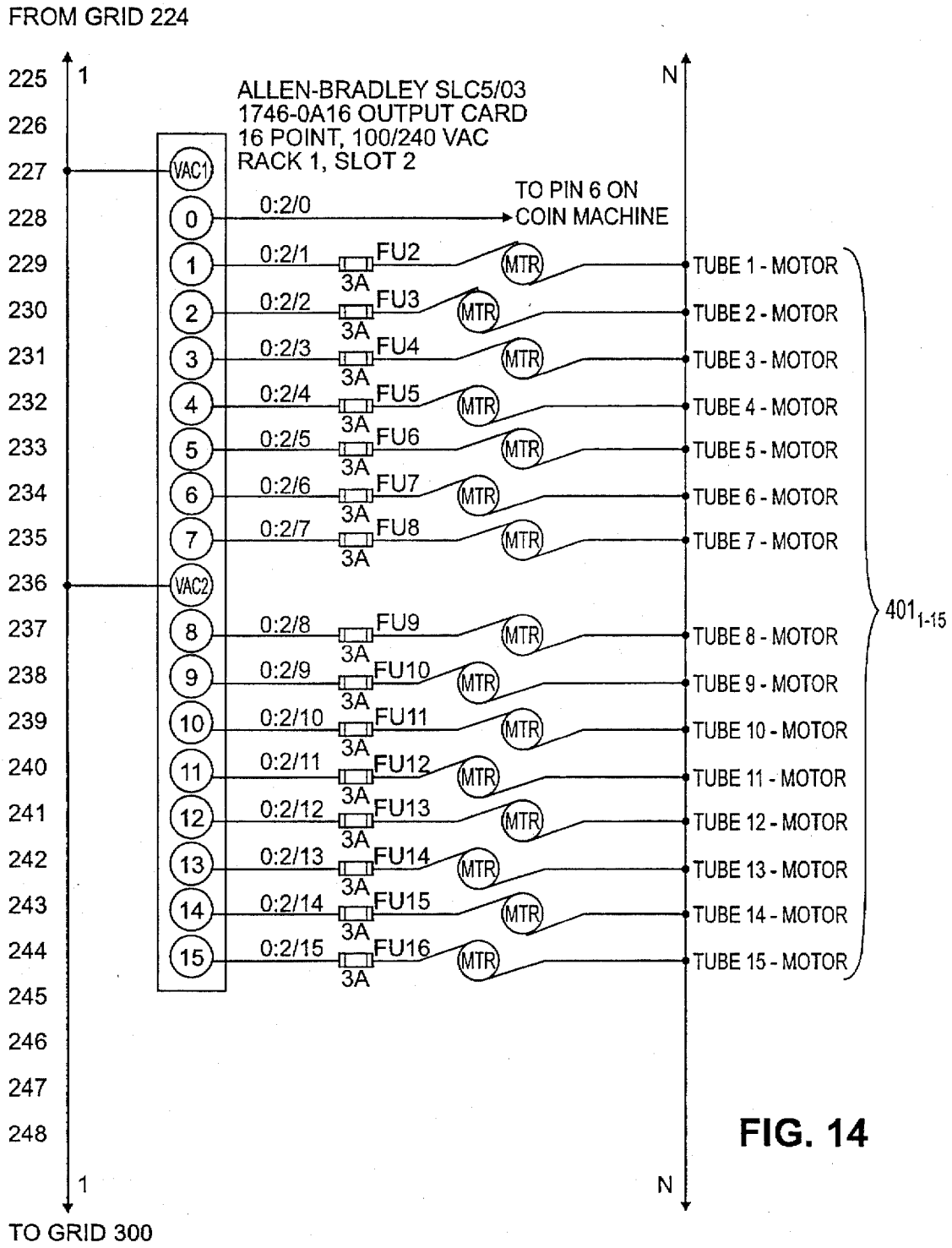
Figure 15:
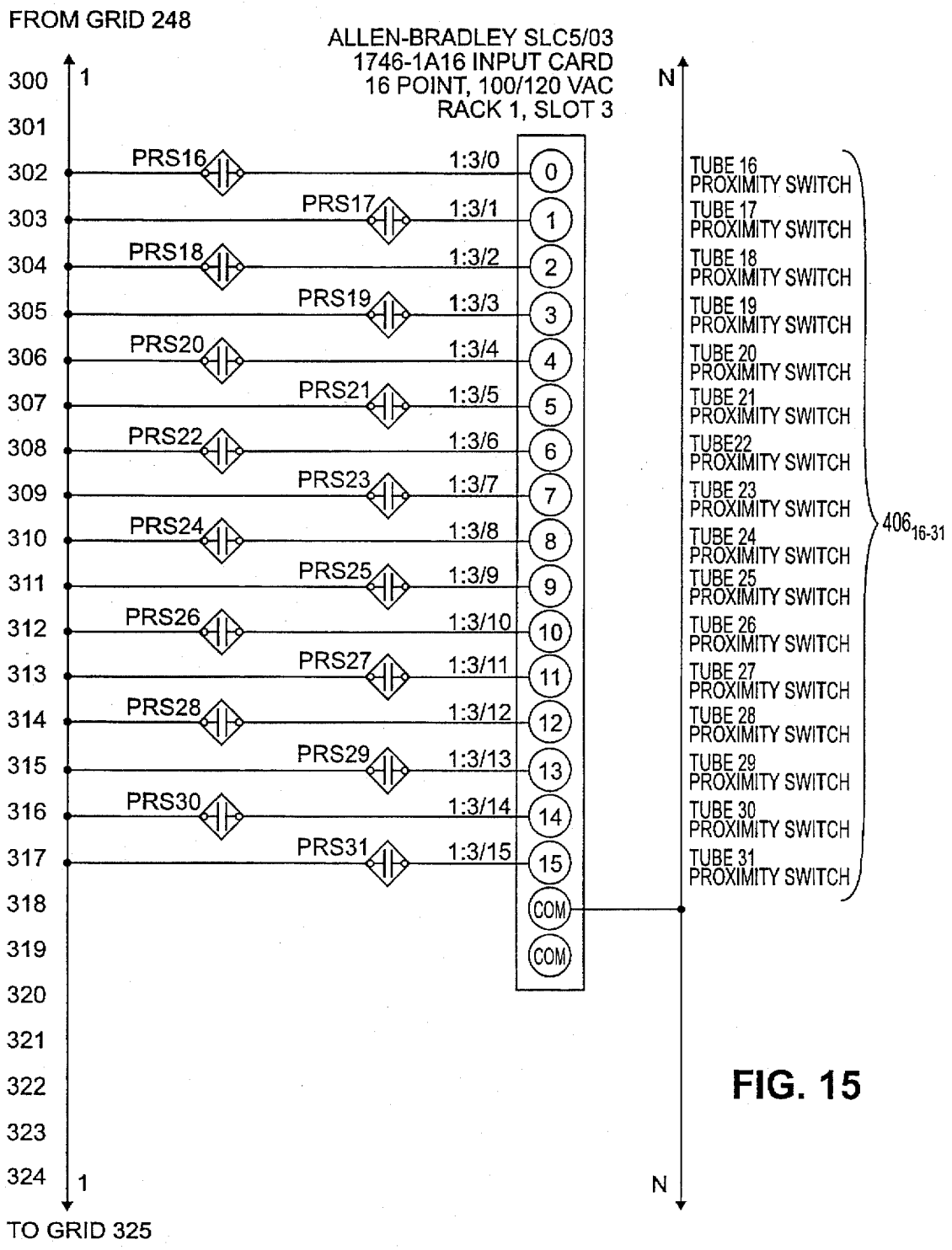
Figure 16:
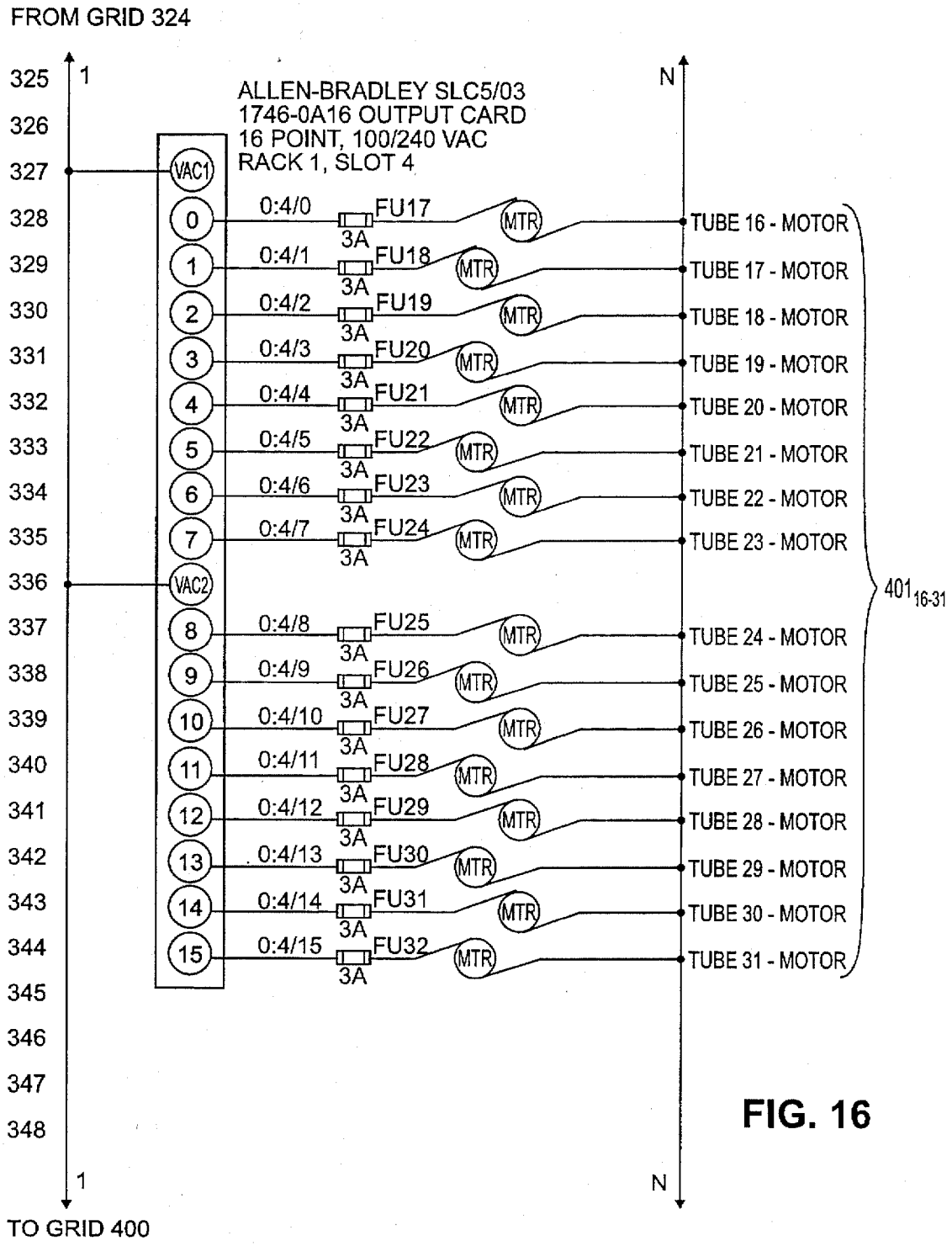
Figure 17:
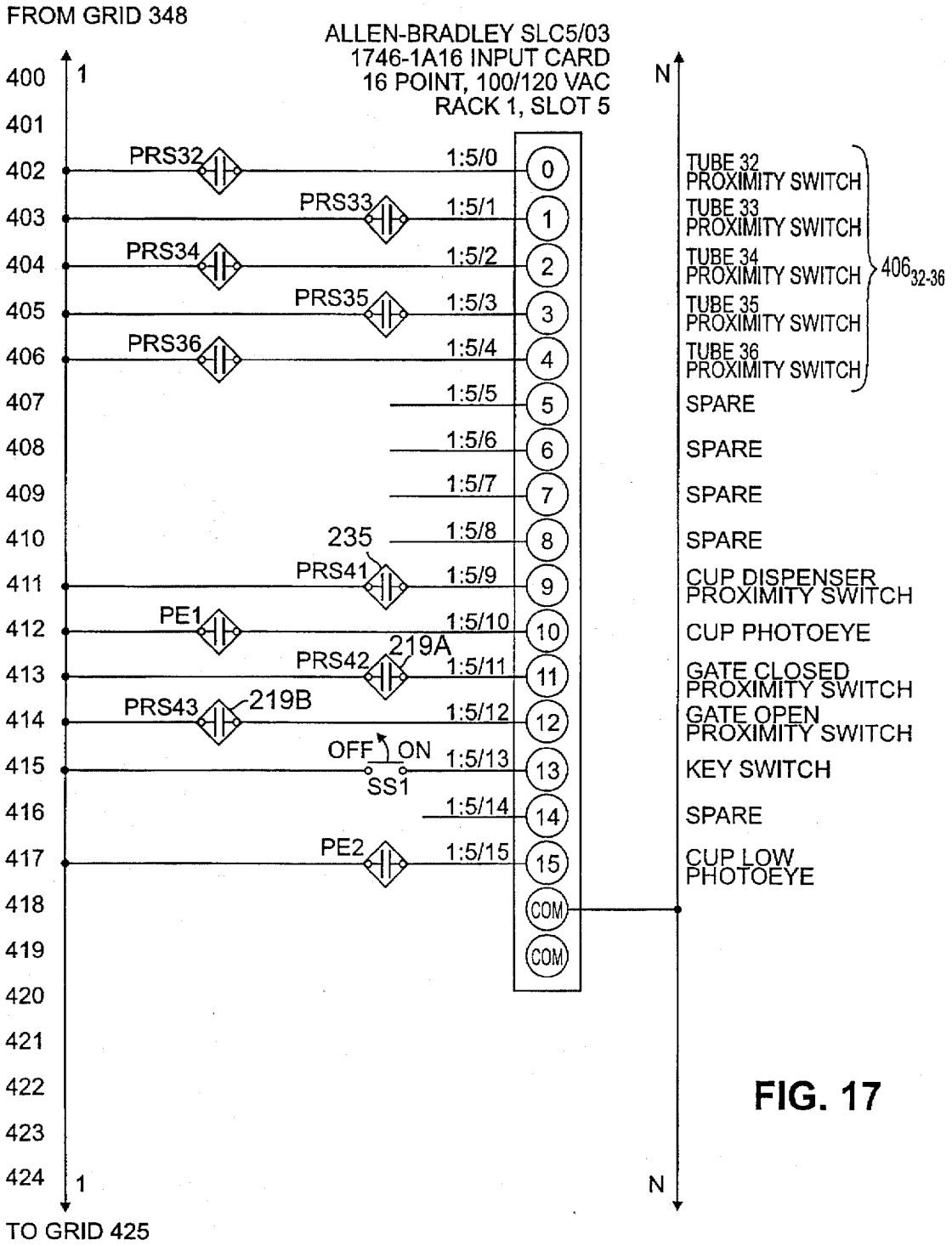
Figure 18:
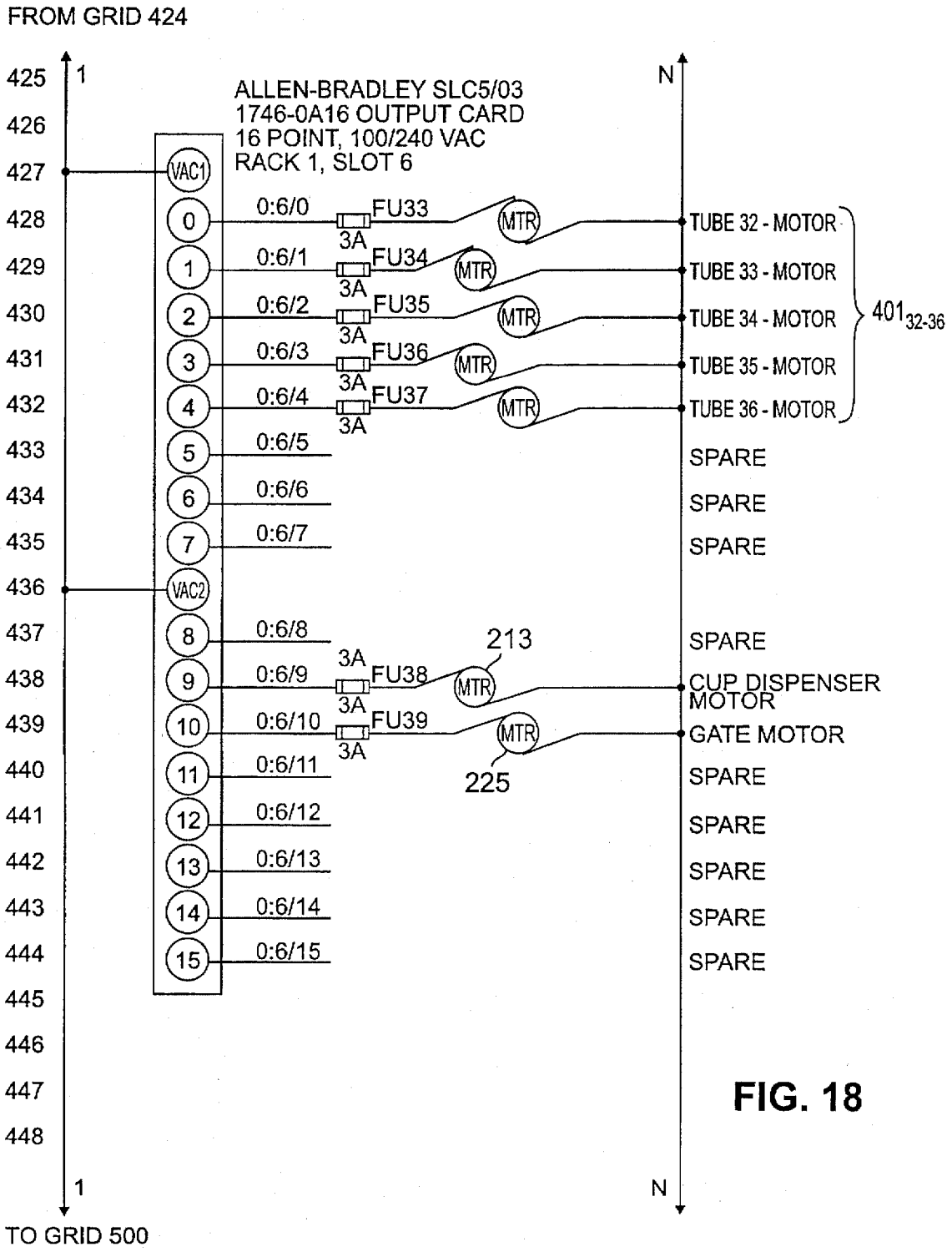

As shown in FIGS. 13, 15 and 17, the PLC 241 monitors a plurality of proximity switches $\mathbf{406}_{1\text{-}36}$ for TUBES 1–36. These TUBES 1–36 are the 36 bins 200 of the presently preferred embodiment. These switches $\mathbf{406}_{3\text{-}6}$ are the switches which sense the state of the dispensers 400 as discussed above in connection with FIG. 8A. Also, as shown in FIGS. 14, 16 and 18, the PLC 241 controls the driving of motors $\mathbf{401}_{3\text{-}6}$ for the TUBES 1–36. These motors drive the dispensers 400 as discussed above in conjunction with FIG. 8A.

Also, as illustrated in FIGS. 17 and 18, the PLC 241 also controls a cup dispenser motor 231 which is part of the cup dispenser 230 shown in FIG. 4, the gate motor 225 of FIG. 9A which controls the dropping of product from the hopper 210, and monitors the cup dispenser proximity switch 235 to determine if a cup has dropped properly and is in place for dispensing, gate closed and open proximity switches 219A and 219B to monitor the position of the gate 219 and various photoeyes to monitor various conditions of components of the machine 100.

Figure 19:
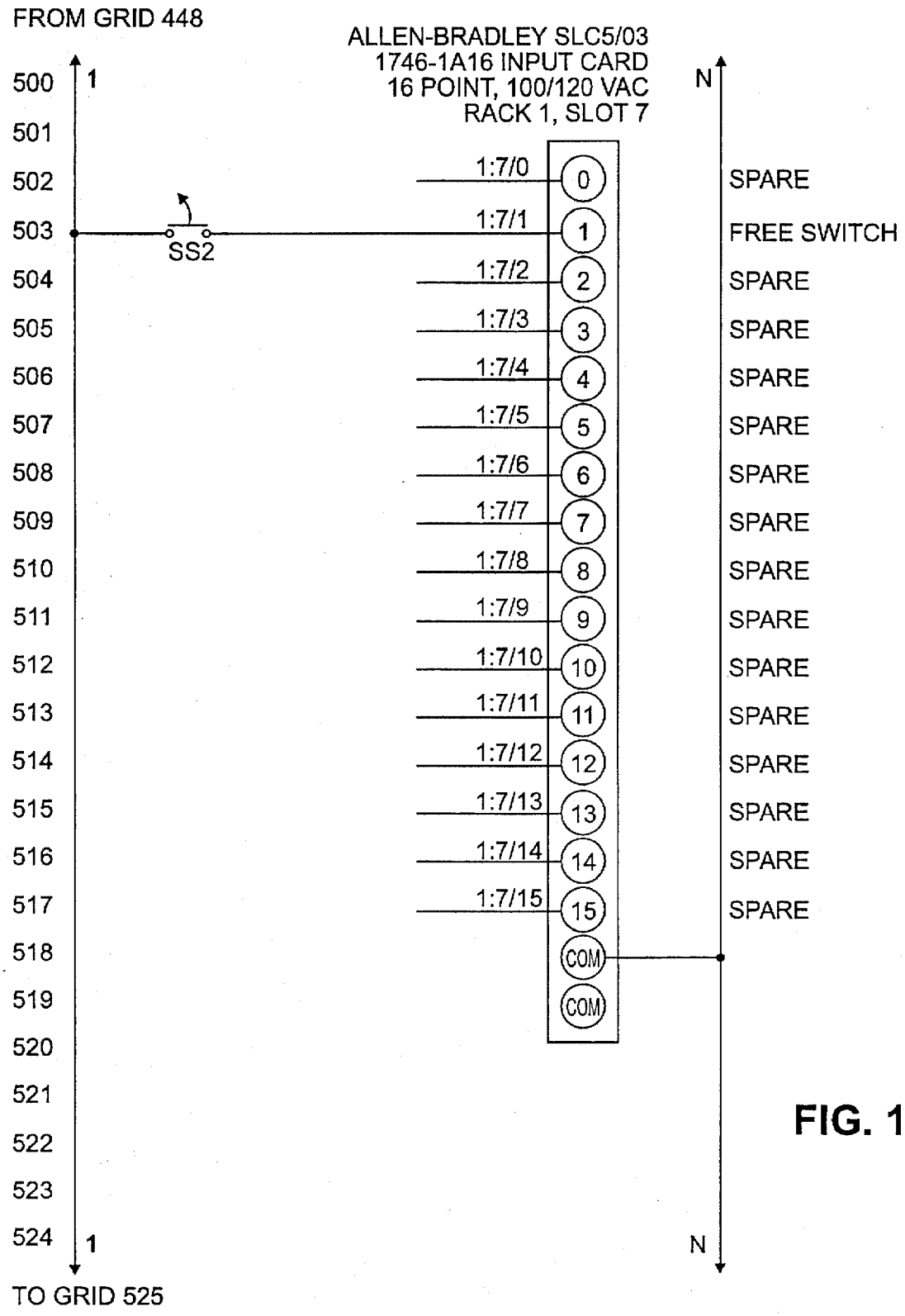
Figure 20:
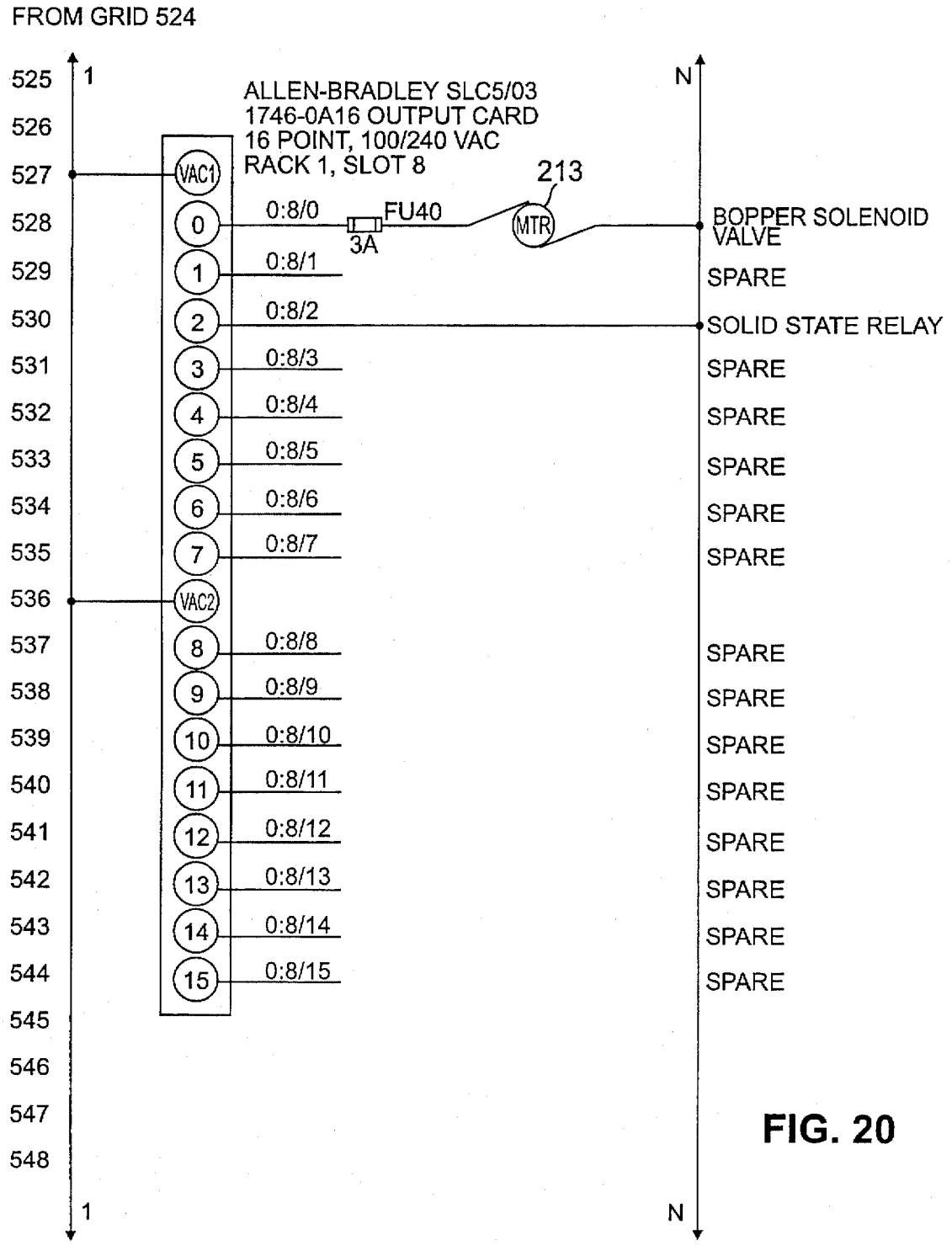

A number of spare lines are provided as seen in FIGS. 19 and 20. FIG. 19 also shows a free switch SS2 which gives the operator or owner of the machine 100 the option of putting it in a free vend mode or not. In free vend mode, all selections may be vended for free. FIG. 20 also shows that the PLC 241 may optionally control a hopper motor MTR or solenoid 213 for shaking or vibrating the hopper 210 as discussed above.

In addition to its role in providing selection data to the PLC 241, the computer 240 controls the graphics of the touch-screen 120 and responds to customer inputs during the product selection process. Further details of a presently preferred embodiment of this operation are provided below.

While it will be recognized that a much simpler user interface may be employed, it is presently preferred to employ a highly animated and colorful approach to maximize customer interest and satisfaction with the machine 100. The fiber-optic sign or display 185 and the speakers 251 and 252 are preferably utilized to attract the customer's initial attention and then to enhance the vending experience during the selection process. Once the customer's attention is attracted, a series of display screens attached hereto as Appendix C is presently preferred. For vending plain "M&M's" chocolate candies, a colorful and cheery picture of a fanciful m&m® candy embodied as a character might invite a customer to touch the touch-screen 120 to continue or begin the selection process.

Upon touching the first screen, an options screen may then be presented. By way of example, the customer may be presented with instructions to insert a specified amount of money to get a specified amount of product, such as $5 for a 24 ounce cup of plain "M&M's" chocolate candies. Alternatively, the customer might be invited to insert an amount to be determined by the customer to purchase an amount selected by the customer. It is noteworthy that the present invention provides the flexibility to provide the latter option.

Subsequently, a number of options boxes, such as box for selecting an animated video of a fanciful factory to allow the user to operate the factory to create his or her own blend of plain "M&M's" chocolate candies; Pick a Quick Mix to select a previously determined mix; or a facts box to gain nutritional or other information about the products might be presented.

If the customer then selects the Quick Mix option, the next screen may display a number of options, such as HOLIDAYS, MYSTERY, SCHOOLS, SPORTS FANS, AROUND THE WORLD and the like, with appropriate follow-on screens for each. By way of example, a HOLIDAY selection might be followed by a screen listing various holidays and a picture or pictures indicating the colors for the mix. Again, by example, selection of the "FOURTH OF JULY BLEND" would result in a mix of red, white and blue plain "M&M's" chocolate candies. The picture for such a selection box could suitably be a United States flag. The next screen might display the colors selected in word and color and give the customer the option of confirming the selection or going back and changing the selection. If the selection is confirmed, vending proceeds as discussed above.

If alternatively, the customer had chosen MYSTERY, a screen with a series of doors might be presented with the customer being given the option of picking a door. Upon picking a door, a MYSTERY or random mix selected by the machine 100 would be dispensed. A significant advantage of this approach is that the machine 100 can be readily programmed through the programming of its PLC 241 to keep track of the amounts of product in inventory in the bins 200, and then the MYSTERY mixes may be selected from those products which are not selling well. Preferably, the program will lock-out or prevent mixes which are aesthetically unsatisfying to the majority of customers. Other beneficial mixes can be readily programmed as well. For example, the MYSTERY mix could empty out the most popular bins that are nearly empty just prior to a regularly scheduled refill visit by a vending operator or stocker.

The SCHOOLS option might present a display screen or screens showing a number of school names and colors. Selection of a school would then result in a mix of that school's colors. Alternatively, a customer can select school colors to fill in a school banner, its trim and the school name. Similarly, a SPORTS option might present screens that would prompt a customer to select various colors for an athlete's uniform, such as a basketball player's uniform, its numbers and the uniform trim. The listed colors could be displayed and then vended.

The AROUND THE WORLD option might display a map of the world so that a customer could select a region, a country and then a country's flag to get a mix of the colors in his or her country's flag. It will be readily apparent from the above discussion that a wide variety of options are available to effectively market and promote the products 120 to be vended by the machine 100. The present invention provides the flexibility to readily employ any such options.

If the animated video option is selected, the animated video is presented to allow the customer to have fun selecting his or her own blend of plain "M&M's" chocolate candies. In a presently preferred embodiment, the customer can select up to six different colors. With a final 24 ounce total vend, the customer can choose as little as one ounce of a given color. The machine 100 is presently preferably set up to automatically make the total of the customer's selections add up to 24 ounces. As the fanciful factory completes its operation, the selected blend is dispensed. Again, while a specific example is discussed above, the present invention is widely applicable to a widerange of effective audiovisual product presentations matched to a given location, time of year, event, promotion or the like. This flexibility is not found in typical vending machines.

While the invention has been described above principally in the context of a presently preferred embodiment, it will be recognized that the general principles of the invention are more widely applicable. The present invention provides many advances in automatic bulk vending. As discussed briefly above, the automatic bulk vending concepts of the present invention will be readily adapted to a lower cost automatic vending machine by leaving out the presently preferred audiovisual and touch-screen aspects. A prior art machine such as machine 1 of FIG. 1 may be transformed into a machine according to the present invention by eliminating its prior art product delivery system for dispensing prepackaged items and replacing that delivery system with a bulk delivery system as taught herein scaled to the appropriate scale for the particular machine. Many other modifications consistent with the teachings of the present invention will also be apparent.

It should be understood that the embodiments and variations shown and described above are merely illustrative of the principles of this invention, and that various modifications may be implemented by those skilled in the art without departing from the scope and spirit of the invention.

We claim:

1. An automatic bulk vending machine for delivery to a customer of a customer selected blend selected from a plurality of non-liquid products stored in bulk comprising:

a plurality of bins to store products to be selected;

a customer selection mechanism to enable the customer to select a blend of products;

a dispenser mechanism responsive to the customer selection mechanism to dispense customer selected products;

a fines separator and collector; and a package mechanism operably connected to provide a package to receive the customer selected products dispensed by the dispenser mechanism.

2. The apparatus of claim 1 wherein the dispenser mechanism includes a volumetric dispenser capable of receiving and dispensing a predetermined amount of a product from one of said plurality of bins.

3. The apparatus of claim 2 wherein the dispenser mechanism further includes a blending and holding pan arranged beneath the volumetric dispenser.

4. The apparatus of claim 1 wherein the dispenser mechanism includes a blending and holding pan.

5. The apparatus of claim 4 wherein the dispenser mechanism further includes a controllably moveable gate for controllably holding and releasing products from the blending and holding pan.

6. The apparatus of claim 4 wherein surfaces of the blending and holding pan are angled with respect to horizontal at a minimum angle sufficient to overcome product friction on the surface.

7. The apparatus of claim 6 wherein said minimum angle is about 25° or greater.

8. The apparatus of claim 4 wherein the blending and holding pan is slideably mounted for ease of cleaning and maintenance.

9. The apparatus of claim 1 wherein the package mechanism is a cup dispenser which controllably drops a cup to a product delivery area just prior to product delivery.

10. The apparatus of claim 1 wherein the fines separator and collector is located between the dispenser mechanism and a product delivery area.

11. The apparatus of claim 10 wherein the fine separator and collector is comprised of a bottom portion of spaced rods spread apart by a distance sufficient to allow fines to fall between the rods, but to prevent whole products from falling through.

12. The apparatus of claim 1 wherein the customer selection mechanism comprises a touch-screen display which provides a video display of customer options which can be selected by the customer by touching the touch-screen display as indicated.

13. The apparatus of claim 1 further comprising a factory filled, sealed plastic container for readily loading products into the plurality of bins in a sanitary fashion.

14. The apparatus of claim 13, wherein at least one of the plurality of bins includes a cutting mechanism for automatically opening the factory filled, sealed plastic container, upon its insertion into said at one bin.

15. The apparatus of claim 1 further comprising a bill validator to receive a customer's money for payment for the customer selected products.

16. The apparatus of claim 1 further comprising a coin mechanism to receive a customer's money for payment for the customer selected products and to dispense change if any is owed to the customer.

17. The apparatus of claim 1 wherein the package mechanism further comprises a lid dispenser.

18. The apparatus of claim 1 further comprising a rotatable display of samples of the products stored in bulk in the plurality of bins.

19. The apparatus of claim 1 further comprising a tip-preventive trolley assembly, and wherein said plurality of bins are mounted on said trolley assembly so that they may be guided out of the automatic bulk vending machine for easy refilling.

20. The apparatus of claim 1, wherein the fines separator and collector comprises:

a tubular separator having a plurality of spaced rods; and a removable cup for collecting the fines.

21. The apparatus of claim 1, wherein the package mechanism further comprises a sensor for generating a signal when a package is correctly positioned and before dispensing occurs to prevent spillage.

22. The apparatus of claim 1, wherein the customer selection mechanism further comprises a fiber-optic display.

23. The apparatus of claim 22, further comprising a fiber-optic projector connected to the display by a fiber-optic bundle.

24. A method for automatic bulk vending for delivery to a customer of a customer selected blend selected from a plurality of consumable non-liquid food products stored in bulk comprising:

storing a plurality of items to be selected;

presenting choices of items to be selected to the customer;

automatically accepting payment for the selected blend of items;

blending the items;

separating the fines from the items; and dispensing the customer selected blend of items into a package.

25. A method for operating an automatic bulk vending machine to deliver a customer selected blend of product from a plurality of consumable non-liquid food products stored in bulk, comprising:

storing a plurality of products in a plurality of bins to be selected;

presenting choices of products to be selected;

inviting a customer to insert a customer determined amount of money;

sensing the amount of money inserted and determining the amount of product to be vended;

inviting the customer to select a blend of product;

automatically accepting payment for the selected blend of products;

blending the products; and dispensing the customer selected blend of products into a package.

26. The method of claim 25, further comprising separating the fines from the products before dispensing.

27. The method of claim 26, wherein the step of separating the fines from the products comprises passing the products over separated rods.

28. The method of claim 27, comprising vibrating the separated rods to enable the products to complete vending and avoid sticking.

29. The method of claim 25, wherein the step of presenting choices comprises displaying a plurality of option boxes to a customer, wherein each option box corresponds to a particular mix of product.

30. The method of claim 25, wherein the step of presenting choices comprises displaying an animated video option to a customer, wherein a customer selects her own blend of product.

* * * * *

UNITED STATES PATENT AND TRADEMARK OFFICE

CERTIFICATE OF CORRECTION

PATENT NO. : 5,685,435

DATED : November 11, 1997

INVENTOR(S) : John J. Picioccio et al.

It is certified that error appears in the above-identified patent and that said Letters Patent is hereby corrected as shown below:

In Fig. 3, cancel "180" and insert --181--.

Col. 4, line 46, cancel "180" and insert --181--.

Col 4, line 49, cancel "180" and insert --181--.

Col. 4, line 51, cancel "180" and insert --181--.

Col. 8, line 45, cancel "$406_{3-6}$ and insert --$406_{1-36}$--.

Col. 8, line 49, cancel "$401_{3-6}$ and insert --$406_{1-36}$--.

Signed and Sealed this

Tenth Day of November 1998

*Attest:*

*Attesting Officer*

BRUCE LEHMAN

*Commissioner of Patents and Trademarks*